US005564609A

United States Patent [19]

Tsuchiya et al.

[11] Patent Number: 5,564,609

[45] Date of Patent: Oct. 15, 1996

[54] METHOD FOR MOUNTING PANTYHOSE BLANKS

[75] Inventors: Masataka Tsuchiya, Nara-ken; Kazuhisa Sugita; Tamotsu Matsuda, both of Yamatotakada, all of Japan

[73] Assignee: Takatori Corporation, Japan

[21] Appl. No.: 575,123

[22] Filed: Dec. 19, 1995

[30] Foreign Application Priority Data

Dec. 29, 1994 [JP] Japan ..... 6-339622

[51] Int. Cl.[6] ..... D06C 5/00

[52] U.S. Cl. ..... 223/75; 223/77; 112/470.15

[58] Field of Search ..... 223/75, 76, 77, 223/1; 112/470.15, 470.08, 470.12

[56] References Cited

U.S. PATENT DOCUMENTS

| | | | |
|---|---|---|---|
| 4,550,868 | 11/1985 | Hodges | 223/75 |
| 4,564,133 | 1/1986 | Gazzarrini | 223/75 |
| 5,094,371 | 3/1992 | Takamura et al. | 223/75 |
| 5,136,188 | 5/1994 | Froehlich | 223/75 |
| 5,345,889 | 9/1994 | Gazzarrini et al. | 223/75 |
| 5,373,977 | 12/1994 | Migliorini | 223/75 |
| 5,460,108 | 10/1995 | Migliorini | 112/470.15 |

*Primary Examiner*—Bibhu Mohanty
*Attorney, Agent, or Firm*—Bell, Seltzer, Park & Gibson, P.A.

[57] ABSTRACT

A method for mounting pantyhose blanks which enables a pair of pantyhose blanks to be efficiently and accurately mounted on a stretch holder member of a crotch sewing machine employed in pantyhose sewing. Panty portions of a pair of pantyhose blanks are inserted on a pair of upper and lower insertion plates at a first position. At a second position, the panty portions are shifted widthwise on the respective insertion plates so that a cutting site at which the panty portions are to be cut is positioned in alignment with a center line extending across the insertion plate pair. At a third position, the panty portions are drawn so that run guard portions are set in position on the respective insertion plates; the panty portions are stretched in opposite lateral directions by a pair of pawls which act as a transfer member and are held as such before they are withdrawn from the insertion plate pair, the panty portions being then mounted on the stretch holder member of the crotch sewing machine. In this way pantyhose blanks can be accurately positioned and supplied.

15 Claims, 21 Drawing Sheets

METHOD FOR MOUNTING PANTYHOSE BLANKS

BACKGROUND OF THE INVENTION

1. Field of the Invention

The present invention relates to a method for mounting pantyhose blanks which enables a pair of tubular knit pantyhose blanks to be supplied in a proper posture to stretch holder members of a crotch sewing machine.

FIG. 1(A) depicts a stereo-knit type pantyhose blank 1*a* to be used in pantyhose sewing operation. The pantyhose blank includes a panty portion 2, a leg portion 3 formed in continuation from the lower edge of the panty portion 2, and a toe portion 4 formed at the lower end of the leg portion 3, the blank being knit in tubular form. The panty portion 2 consists of a mesh-knit front portion 5, a plain-knit hip portion 6, and a top waist band 7, with its lower end formed as a run guard portion 8 which is connected to the leg portion 3. The hip portion 6 is a stereo-knit portion having a bulge.

FIG. 1(B) depicts a bikini-type pantyhose blank 1*b* consisting of a panty portion 2, a leg portion 3, a toe portion 4, and a waist band 7, wherein the panty portion 2 is formed from a coarse yarn of 30 to 40 denier, while the leg portion 3 is formed from a fine yarn of 12 to 18 denier. The panty portion 2 is so configured that the portion thereof which corresponds to the waist is short while, on the other hand, the portion which corresponds to the crotch is elongated.

FIG. 1(C) depicts a pantyhose blank 1*c* of the T-band type consisting of a panty portion 2, a leg portion 3, a toe portion 4, and a waist band 7, wherein the panty portion 2 has its crotch portion only formed from a coarse yarn as a vertically elongate belt-like portion 2*a*, the remaining portion thereof being formed from the same fine yarn as the leg portion 3.

To sew a pantyhose from such blanks, in the case of the stereo-knit type, as FIG. 2 shows, a pair of above described blanks 1*a* are used in such a way that panty portions 2, 2 of the blanks 1*a*, 1*a* are placed one over the other so that the superposed front portions 5 and hip portions 6 of the two panty portions 2, 2 are cut along a boundary line 9, the thus severed portions being sewn together along a seam 10. In this way, a pantyhose 11 is obtained as shown in FIG. 3(A).

In the case of the bikini type, as FIG. 3(B) shows, panty portions 2, 2 of a pair of blanks 1*b*, 1*b* are vertically cut with respect to a portion corresponding to the crotch, and the portions thus severed are sewn together along a seam 10, whereby a pantyhose 11 is obtained.

In the case of the T-band type, as FIG. 3(C) shows, belt-like portions 2*a*, 2*a* of a pair of blanks 1*c*, 1*c* are vertically cut and the thus severed portions are sewn together along a seam 10, whereby a pantyhose 11 is obtained.

For the purpose of sewing a pantyhose 11 from a pair of pantyhose blanks 1*a*, 1*a*; 1*b*, 1*b*; 1*c*, 1*c* (which hereinafter may sometimes be simply called "blanks"), an automatic pantyhose crotch sewing machine as taught in, for example, Japanese Patent No. 880791 has been widely employed.

Aforesaid automatic pantyhose crotch sewing machine will be briefly described with reference to FIG. 4. The automatic pantyhose crotch sewing machine 21 includes a horizontal carrier 22 driven for intermittent rotation and a plurality of stretch holder members 23 pivotally arranged in spaced apart relation on the carrier 22.

Each stretch holder member 23 comprises right and left arms 26, 26 with upper and lower pairs of holder plates 24, 24 and 25, 25, each pair consisting of right and left holder plates. Each pair of right and left holder plates is back and forth pivotable along the direction of movement of the carrier 22 so that the holder plates can stretch from and contract into their parallel contracted status according to opening/closing movement of the arms 26, 26. Each set of upper and lower holder plate pairs is such that the upper and lower pairs are movable toward and away from each other.

Individual stretch holder members 23 rotate clockwise in FIG. 4 through intermittent rotation of the carrier 22 and are sequentially caused to stop at operating stations (I) through (VI) provided on the track of their rotational movement.

The first operating station I is a position for mounting blanks onto stretch holder member 23 such that blanks are tentatively fitted on upper and lower pairs of holder plates 24, 24 and 25, 25 respectively.

While each stretch holder member 23 fitted with blanks is travelling from the second operating station (II) to the third operating station (III), the blanks which have been tentatively fitted by a positioning device 27 on upper and lower pairs of holder plates 24, 24 and 25, 25 are pulled rearward and, in the case of stereo-knit type blanks, the waist band 7 and run guard portion 8 of each blank are positioned as predetermined. At the third operating station (III), inner thigh portions of the panty portions 2 are cut by a cutting member 28 along a boundary line 9. At the fourth operating station (IV), the horizontal pair of holder plates are stretched apart from each other so that cut edges of the inner thigh portions of the blanks which are held in a superposed condition are exposed to the outside.

In the case of bikini type blanks 1*b*, positioning is made with respect to a vertically central position of each thigh portion, and in the case of T-band type blanks 1*c*, positioning is made with respect to a vertically central position of each belt-like portion 2*a*. Then, respective portions so positioned are vertically cut and then exposed to the outside.

Next, when stretch holder member 23 has moved to a fifth operating station (V), the cut edges of the inner thigh portions of the blanks which are exposed to the outside are sewn together by a sewing machine 29.

Further, upon movement of the stretch holder member 23 to a sixth operating station (VI), the blanks which have been sewn together are removed from the stretch holder member 23, and the horizontal holder plate pair of the stretch holder member 23 return to their initial parallel status from the stretched status, thus moving back to the first operating station (I).

In order to sew a pantyhose from a pair of blanks it is necessary that, in the case of stereo-knit type blanks, the blanks 1*a*, 1*a* be mounted on a stretch holder member 23 in such a condition that the waist bands 7, run guard portions 8 and boundary lines 9 of the blanks are properly positioned in alignment. Likewise, in the case of bikini type blanks 1*b*, as well as T-band type blanks 1*c*, the blanks be mounted on a stretch holder member 23 in such condition that the vertically central portions along which the blanks are to be cut are properly positioned in alignment. Such mounting operation has been performed by manual labor of the operator.

However, the process of manually fitting a pair of blanks on a stretch holder member requires labor and time for the positioning involved, resulting in low sewing efficiency.

SUMMARY OF THE INVENTION

Accordingly, the object of the present invention is to provide a method for mounting pantyhose blanks such that a pair of pantyhose blanks are supplied to a pair of upper and lower insertion plates by being inserted over the plates so that the blanks can be automatically mounted in position on stretch holder members of an automatic crotch sewing machine.

BRIEF DESCRIPTION OF THE DRAWINGS

The above and other objects and features of the present invention will be understood in more detail by reference to the following description taken in conjunction with the accompanying drawings illustrating an embodiment thereof by way of example, in which.

DETAILED DESCRIPTION OF THE PREFERRED EMBODIMENTS

Figure 4:
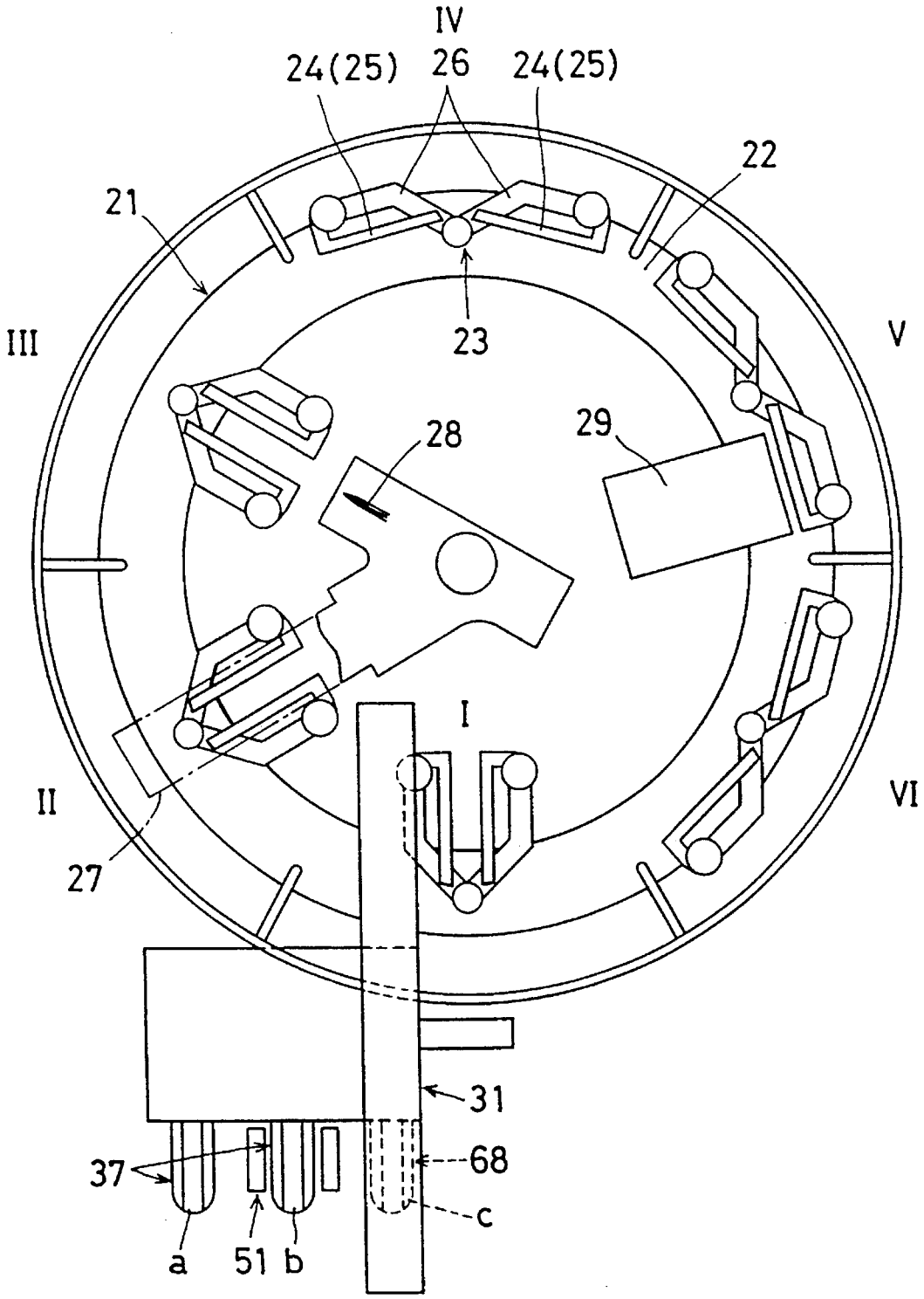
FIG. 4 is a plan view showing a blank mounting apparatus representing a first embodiment and a crotch sewing machine.

FIGS. 4 through 15 illustrate a first embodiment wherein, as FIG. 4 shows, a pantyhose blank mounting apparatus 31 of the present invention is disposed outside a carrier 22 of an automatic pantyhose crotch sewing machine and between a first operating station (I) and a second operating station (II).

Figure 7:
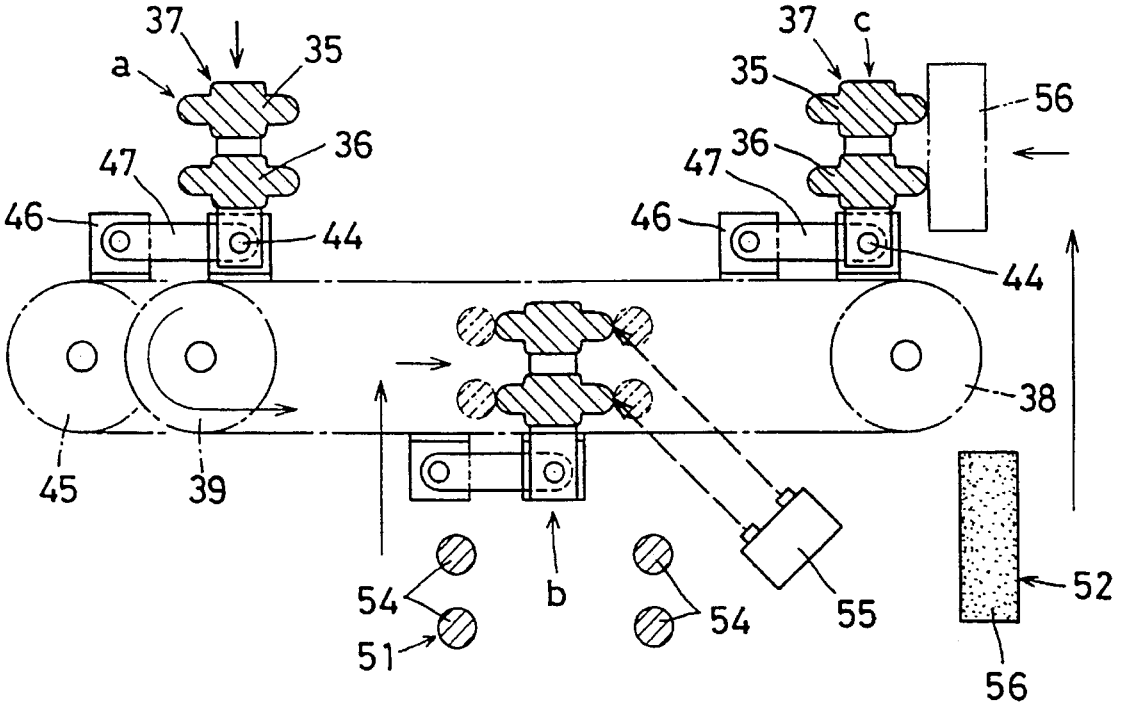
FIG. 7 is a vertical sectional front view taken in the direction of the arrows along the line VII—VII of FIG. 5.
Figure 5:
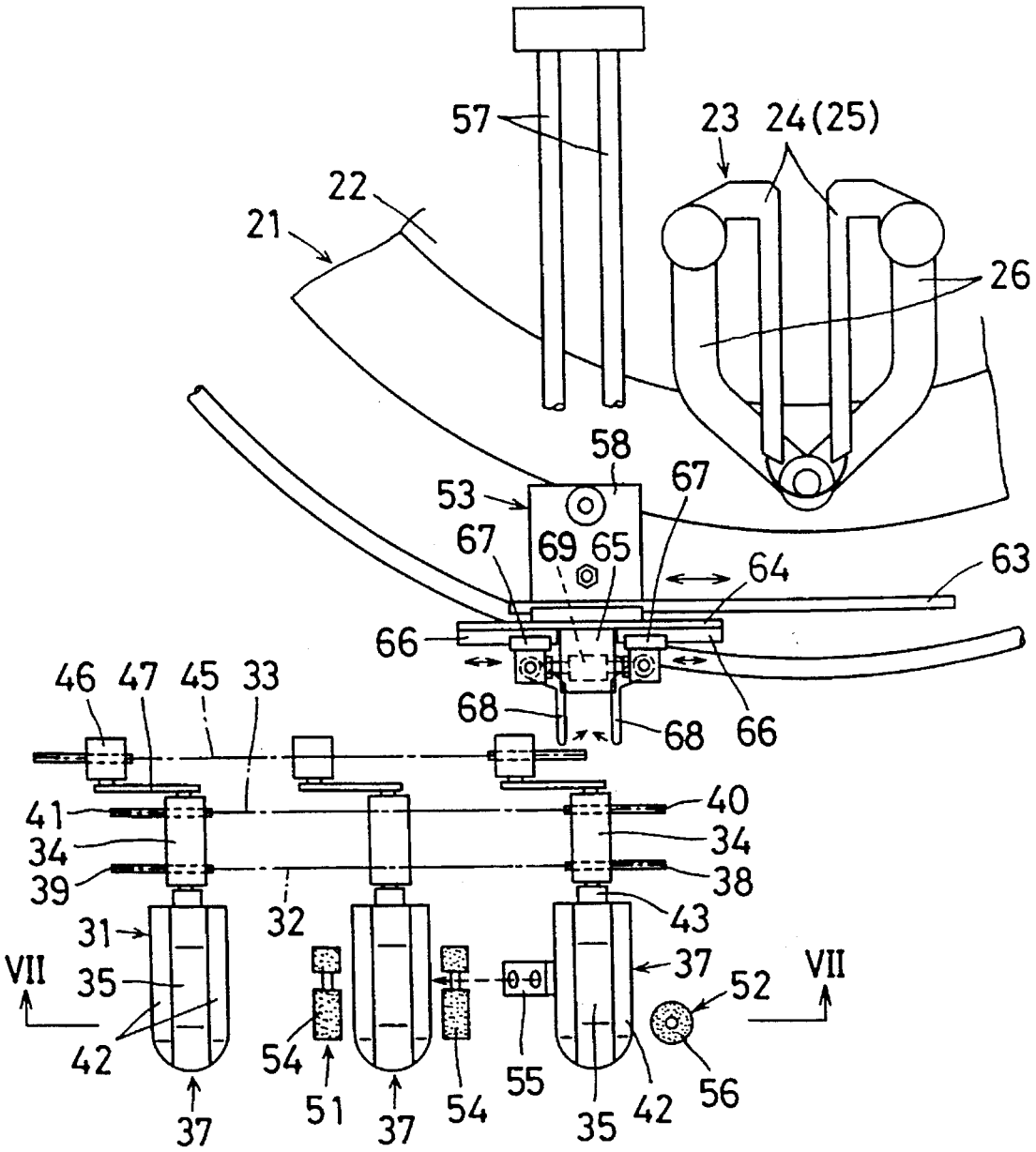
FIG. 5 is a partially cutaway plan view showing the blank mounting apparatus.
Figure 6:
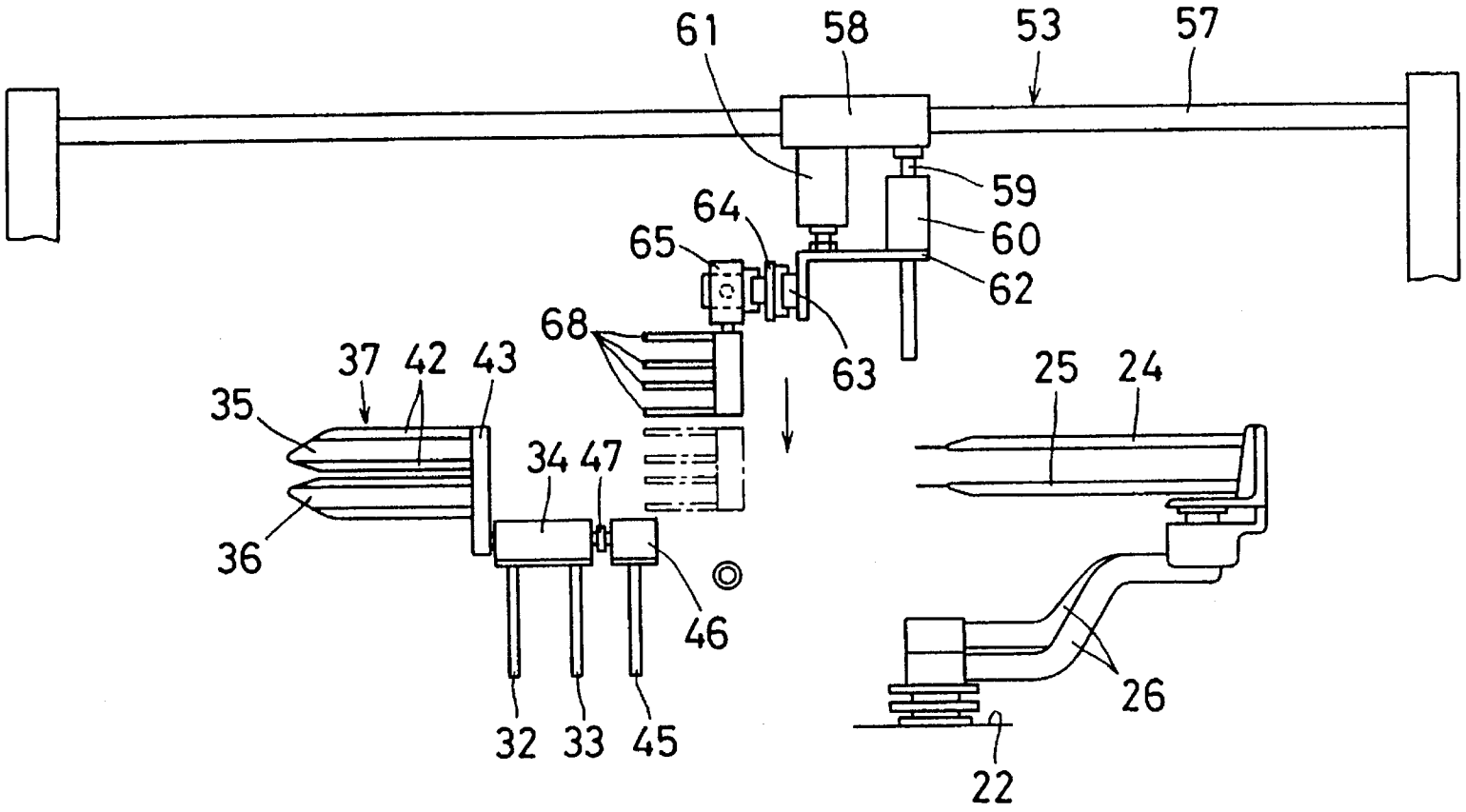
FIG. 6 is a side view showing the mounting apparatus.

The mounting apparatus 31, as shown in FIGS. 5 to 7, includes two endless chains 32, 33 arranged in parallel outside the carrier 22, support blocks 34 fixed to the outer circumferential side of the chains 32, 33 at three circumferentially equispaced locations, and an upper-lower insertion plate pair 37, for insertion thereon of panty portions of a pair of pantyhose blanks, mounted to each of the support blocks 34 on the front side thereof, the insertion plate pair consisting of two vertically opposed insertion plates 35, 36.

The endless chains 32, 33 are respectively entrained between sprockets 38 and 39 and between sprockets 40 and 41, the pairs of sprockets being mounted on horizontal shafts positioned on opposite sides of the chains as viewed in the longitudinal direction thereof, and are arranged in parallel relation to a line extending outside the carrier 22 and tangential to the circumferential edge thereof. The chains are driven to run intermittently in the counterclockwise direction in FIG. 7 at a pitch equal to the intervals at which the blocks 34 are located.

Each insertion plate 35; 36 is an elongated plate having a configuration such that its forward end portion is arcuate in plan view but is sharply tapered when viewed thicknesswise, with stepped grooves 42 formed along opposite edges of the plate. Further, the insertion plate 35; 36 is fixed at its rear end to a shank plate 43. Thus, each pair of insertion plates 35, 36 are fixed so as to be positioned in vertically parallel spaced, opposed relation to form an upper-lower insertion plate pair 37.

Each upper-lower insertion plate pair 37, with its shank plate 43 fixed at the lower end thereof to one end of a shaft 44 supported horizontally rotatably by block 34, is horizontally pivotable about the shaft 44 and extends forwardly of the front side chain 32 as shown in FIG. 5.

An endless chain 45 having a length equal to the length of the rear side chain 33 is placed behind the chain 33, being offset leftward therefrom as in FIG. 5 so that it will rotate in concert with the rear side chain 33. Fixing blocks 46 are mounted to the chain 45 at three circumferentially equispaced locations so that the fixing blocks 46 are positioned more forward or backward than respective upper-lower insertion plate pairs 37 in the rotational direction of the chain, the rear ends of the shafts 44 and respective fixing blocks 46 being interconnected by means of links 47 in that condition so that each respective upper-lower insertion plate pair 37 is held in upright condition for movement.

On the upper run portion of the endless chains 32, 33 and 45, fixing blocks 46, links 47, and shafts 44 are positioned on the chains, and upper-lower insertion plate pair 37 stands upright, while on the lower run portion of the chains, fixing blocks 46, links 47, and shafts 44 are positioned on the underside of the chains. However, it can be arranged that when fixing blocks 46 and shafts 44 shift from the upper run to the lower run, through either the rear side chain 33 or the chain 45, links 47 are caused to turn the corresponding shafts 44 so that upper-lower insertion plate pairs 37 are moved in circulation while being held upright.

Through intermittent rotation of the endless chains 32, 33, as FIG. 7 shows, each upper-lower insertion plate pair 37 is caused to stop at opposite ends of the upper run of the chains 32, 33 and at a median location of the lower run. In the figure, the position at the left end of the upper run which is shown as a stop position for the upper-lower insertion plate pair corresponds to a first position a at which the operator works to insert the panty portion of a blank over each of the upper and lower insertion plates 35, 36. The position shown in the middle of the lower run as a stop position for the upper-lower insertion plate pair 37 corresponds to a second position b at which the panty portions inserted over the insertion plates 35, 36 are laterally moved on the insertion plates 35, 36 so that the site at which the panty portions are to be cut is positioned in alignment with a center line extending across the insertion plates 35, 36. The position shown at the right end of the upper run corresponds to a third position c at which panty portions or hip portions of the blanks are drawn in creased condition onto the insertion plates 35, 36 of the upper-lower insertion plate pair 37 for placement in position on the insertion plates 35, 36, the blanks being then withdrawn from the insertion plate pair, and at which the panty portions so withdrawn are mounted on stretch holder members 23 of the crotch sewing machine 21 while creases on the withdrawn panty portions are being smoothed down.

At the first position a, the operator performs the process of inserting the welt panty portions of the blanks over the upper and lower insertion plates 35, 36 respectively. At the second position b there is disposed a positioning mechanism 51 for shifting the panty portions across respective insertion plates 35, 36. At the third position c there are disposed a drawing mechanism 52 for drawing hip portions in creased condition onto the insertion plates 35, 36, and a pull-out and mount mechanism 53 which is back and forth movable between the insertion plates 35. 36 and the crotch sewing machine 21 and operative to pull out blanks from the insertion plates 35. 36 and mount the same on a stretch holder member 23 which has stopped at the first operating station (I) of the crotch sewing machine 21.

The positioning mechanism 51 at the second position b is shown in FIGS. 5 and 7 as one adapted for use with stereo-knit type blanks which comprises two pairs, upper and lower, of revolving rollers 54, 54, the revolving rollers of each pair being in horizontally opposed relation across an upper-lower insertion plate pair 37, and a sensor 55 operative to control the revolving rollers 54, 54. The horizontally opposed revolving rollers 54, 54 and 54, 54 are movable toward and away from each other, and when taken as upper and lower revolving rollers 54, 54, they are arranged at a spacing equal to that between upper and lower insertion plates 35, 36 and in parallel relation to the insertion plates 35, 36. Therefore, these rollers are upward and downward movable so that at their elevated position the horizontally opposed rollers move toward each other to hold the insertion plates 35 and 36 at opposite sides and turn the panty portions inserted over the insertion plates 35, 36.

Figure 1:
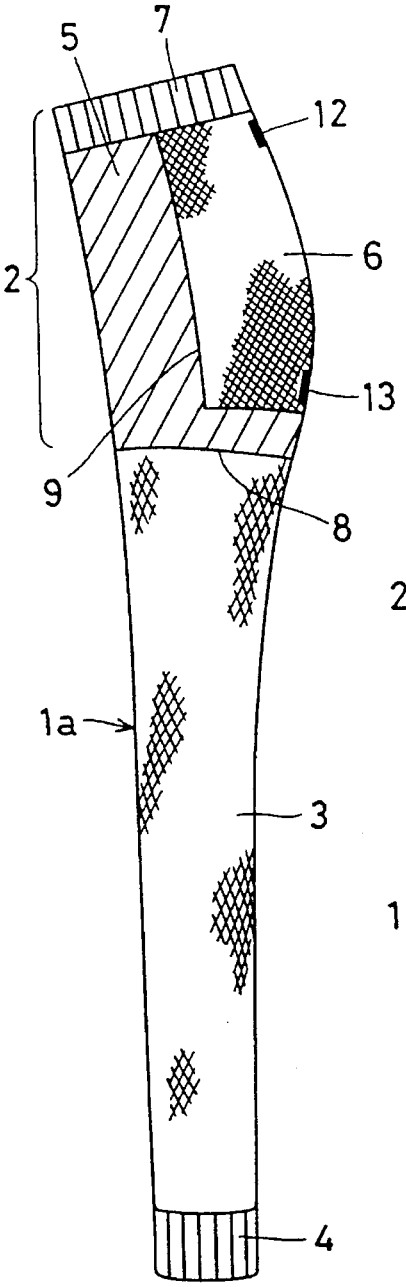
FIG. 1(A) is a side view of a stereo-knit type pantyhose blank.
FIG. 1(B) is a perspective view of a bikini type blank.
FIG. 1(C) is a perspective view of a T-band type blank.
Figure 1:
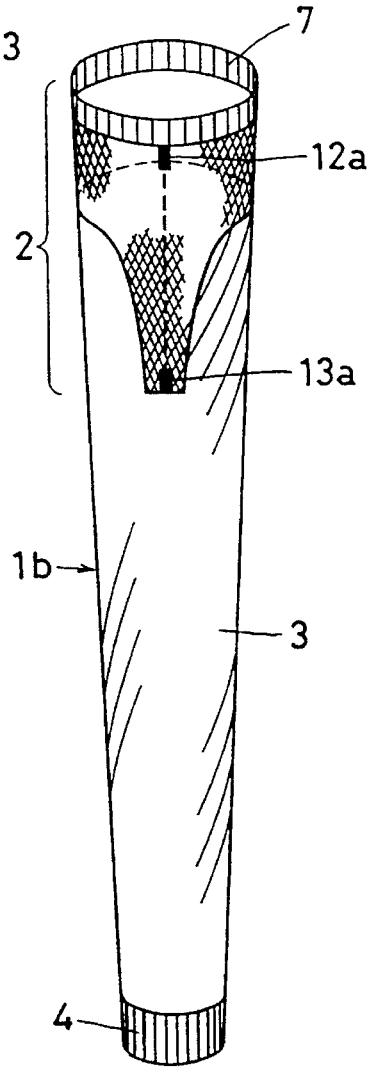
Figure 1:
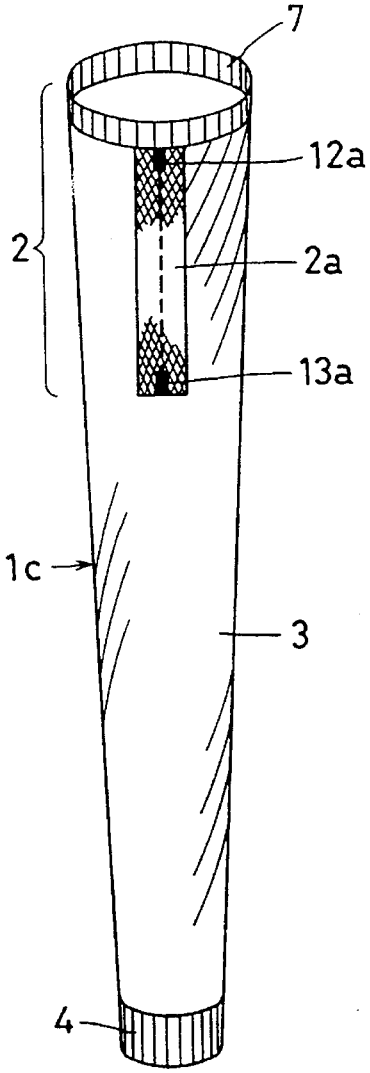
Figure 2:
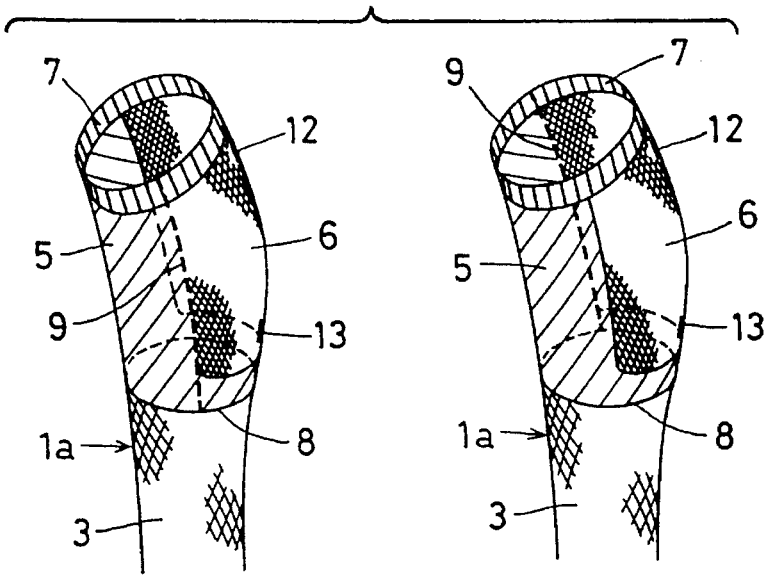
FIG. 2 is a perspective view showing a pair of pantyhose blanks.
Figure 3:
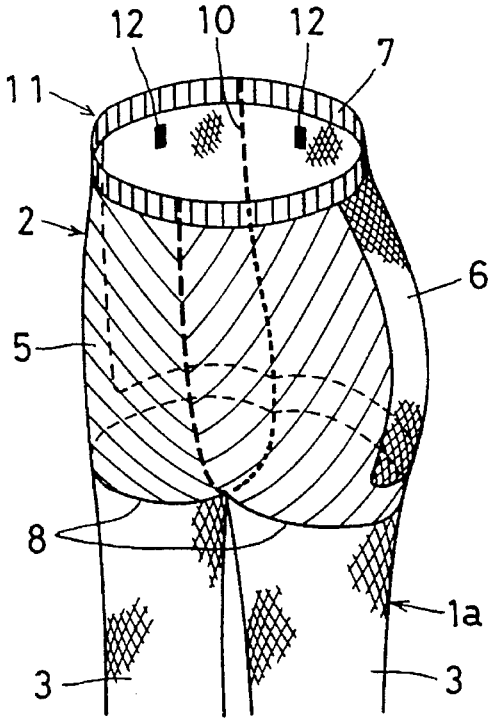
FIG. 3(A) is a perspective view of the stereo-knit type pantyhose.
FIG. 3(B) is a perspective view of the bikini type pantyhose.
FIG. 3(C) is a perspective view of the T-band type pantyhose.
Figure 3:
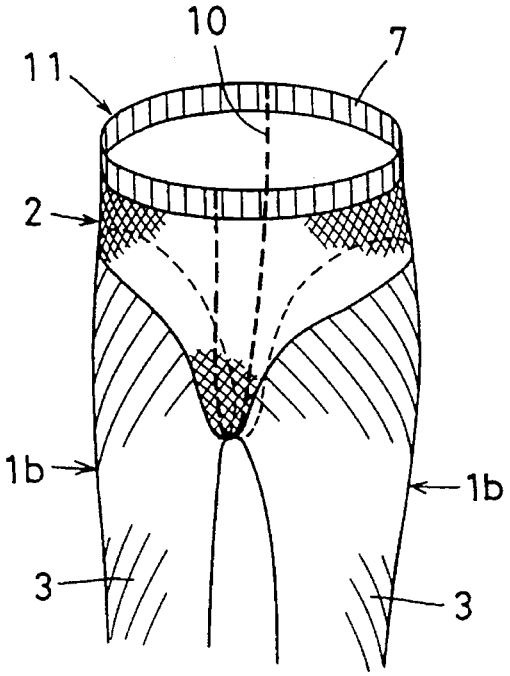
Figure 3:
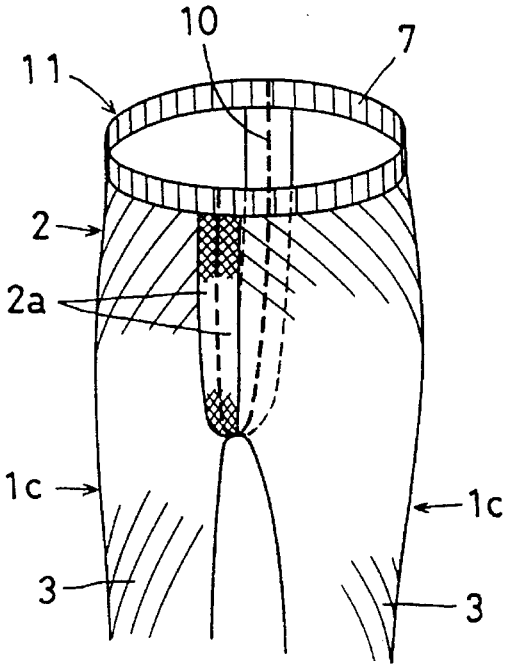

Each pantyhose blank 1*a* of the stereo-knit type, as shown in FIGS. 1(A), 2 and 3(A), contains marking yarns 12, 13 different in color from the hip portion 6 which are provided at a circumferentially median location or locations in the upper end portion and/or lower end portion of the hip portion 6 so as to enable the boundary 9 between the front portion 5 and the hip portion 6 of the panty portion 2 to come into alignment with a center line extending across the insertion plates 35, 36. The sensor 55 optically detects the upper end marking yarn 12 when the yarn is positioned at a side of the insertion plates 35, 36, whereupon the sensor causes the revolving rollers 54, 54 to stop and move away from each other. The sensor 55 is disposed obliquely downward relative to the upper-lower insertion plate pair 37 so as to be able to separately detect marking yarns 12 of the upper and lower blanks. Thus, it will separately control the upper and lower revolving rollers 54, 54.

The drawing mechanism 52 at the third position c comprises a vertical revolving roller 56 disposed so as to be movable toward and away from forward end portions of each upper-lower insertion plate pair 37 at the right side thereof in FIG. 7 when the insertion plate pair stops at that position c. At its elevated position the vertical revolving roller moves toward the upper-lower insertion plate pair 37 to draw the hip portion 6 onto the insertion plate 35, 36 in creased condition, with the run guard portion 8 positioned at right angles relative to a center line extending across the insertion plate 35, 36.

The pull-out and mount mechanism 53, as shown in FIGS. 5 and 6, comprises a guide shaft 57 lying right above the upper-lower insertion plate pair 37 at the third position and extending in the longitudinal direction of the insertion plate pair 37 in parallel relation thereto to a location above the crotch sewing machine 21, a slider 58 slidable along the length of the guide shaft 57, an inverted L-shaped bracket 62 disposed below the guide shaft 57 and guided by a guide shaft 59 and a guide 60 for vertical movement, a first guide rail 63 fixed horizontally to the fore side of the bracket 62 and extending in orthogonal relation to the guide shaft 57, a traverse member 64 mounted on the front side of the first guide rail 63 and laterally movable along the guide rail 63, a bracket 65 disposed centrally in front of the traverse member 64, second guide rails 66, 66 arranged horizontally in front of the traverse member 64 and at opposite sides of the bracket 65, mobile members 67, 67 movable along the second guide rails 66, 66, pawls 68, 68 pivotally mounted to the underside of the mobile members 67, 67 which act as transfer members, and a cylinder 69 fixed to the bracket 65 and operative to move the pawls 68, 68 toward and away from each other through the mobile members 67, 67.

The pawls 68, 68 are provided in vertically spaced sets of four each in corresponding relation to the respective recessed step portions 42 of the upper and lower insertion plates 35, 36 so that the pawls advance into the respective recessed step portions 42 of the upper and lower insertion plates 35, 36 which stop at the third position c during the stage of advancing movement.

In FIGS. 5 and 6, the pawls 68, 68 are shown as being in a standby condition at their starting position, and the slider 58 is at a stop between the carrier 22 and the upper-lower insertion plate pair 37 which stops at the third position c, the cylinder 69 being contracted so that the pawls 68, 68 are positioned above the upper-lower insertion plate pair 37. In this condition, the cylinder 69 is stretched to lower the pawls 68, 68 as shown by a phantom line in FIG. 6, whereupon the pawls 68, 68 are brought to a level even with respective recessed step portions 42 formed at both sides of the upper and lower insertion plates 35, 36. At this time, the sets of pawls 68, 68 at opposite sides are moved toward each other through the contraction of the cylinder 69 so that the pawls 68, 68 are so spaced as to be ready for entry into the recessed step portions 42 at both sides of the upper and lower insertion plates 35, 36 as shown in FIG. 5.

In the case of bikini type pantyhose blanks 1*b*, as FIGS. 1(B) and 3(B) show, the blank has marking yarns 12*a*, 13*a* of different color provided in the crotch portion of panty portion 2 at upper and lower ends thereof. In the case of T-band type pantyhose blanks 1*c*, the blank has marking yarns 12*a*, 13*a* provided in the belt-like portion 2*a* at upper and lower ends thereof. In case that these blanks 1*b*, 1*c* are used, the positioning mechanism 51 at the second position b includes a sensor unit 55*a* which, as FIGS. 10(D) and 10(F) show, comprises sensors 55*b*, 55*c* mounted to a front end portion of an arm at opposite sides thereof which is back and forth movable between upper and lower insertion plates 35 and 36, the sensor unit 55*a* serving the purpose of detecting the upper side marking yarn 12*a*. Upon entry of the sensor unit 55*a* into a space between the insertion plates 35 and 36, the sensors 55*b*, 55*c* are oriented in the direction of a center line extending across the insertion plates 35, 36.

The construction of the pantyhose blank mounting apparatus 31 of the first embodiment has been described above, and next the method for mounting blanks will be described mainly with reference to FIGS. 8 through 15.

Initially, the operator inserts panty portions 2 of a pair of blanks onto insertion plates 35, 36 of an upper-lower insertion plate pair 37 which stops at the first position a. In the case of stereo-knit type blanks 1*a*, 1*a* shown in FIGS. 9(A), 9(B), inserting the panty portions 2 onto the insertion plates 35, 36 does not require any consideration with respect to the position of a boundary 9 between the front portion 5 and the hip portion 6 of panty portion 2, it being only necessary that the panty portions 6 be inserted to the extent that run guard portions 8 are positioned at forward end portions of the insertion plates 35, 36. No registration is required in the inserting operation. This provides an advantage that inserting operation can be done easily and efficiently.

Figure 9A:
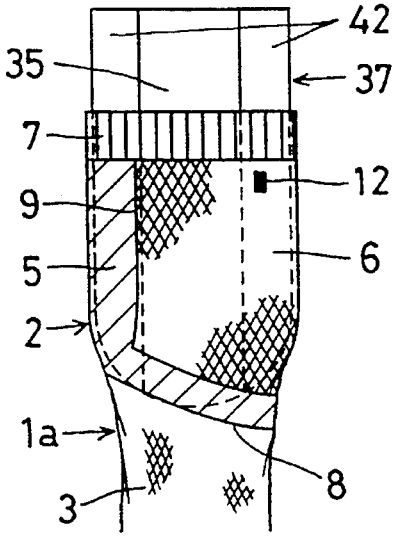
FIG 9(A) is a plan view showing a panty portion of the stereo-knit type blank at a first position at which the panty portion is inserted over an insertion plate.
Figure 9B:
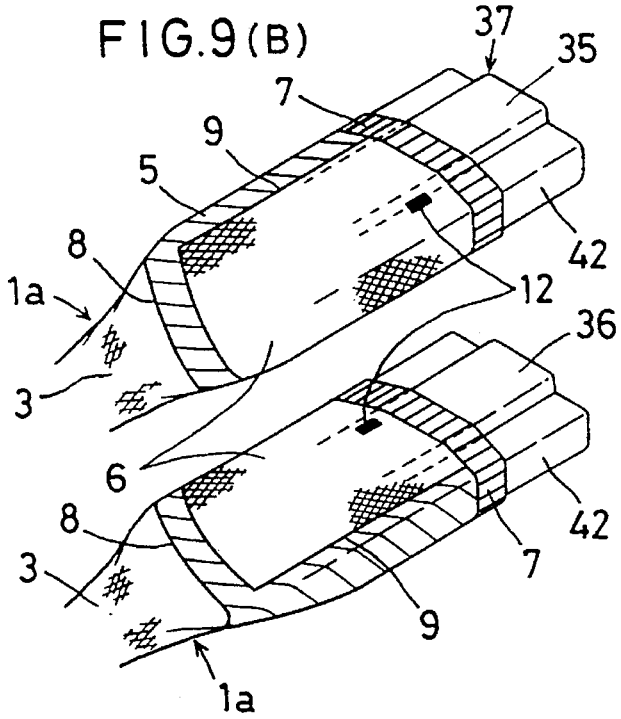
FIG. 9(B) is an exploded perspective view of an insertion plate pair at aforesaid position.
Figure 9C:
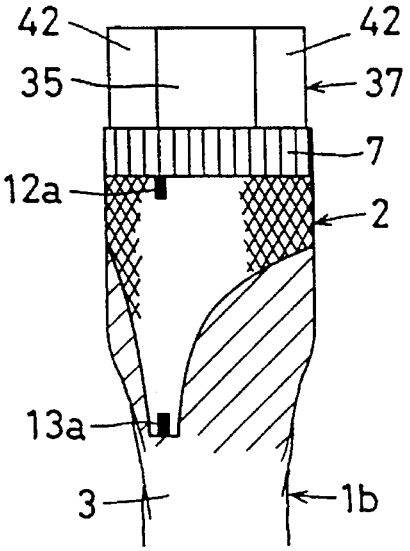
FIG. 9(C) is a plan view showing a panty portion of the bikini-type blank at a first position with the panty portion inserted in place.
Figure 9D:
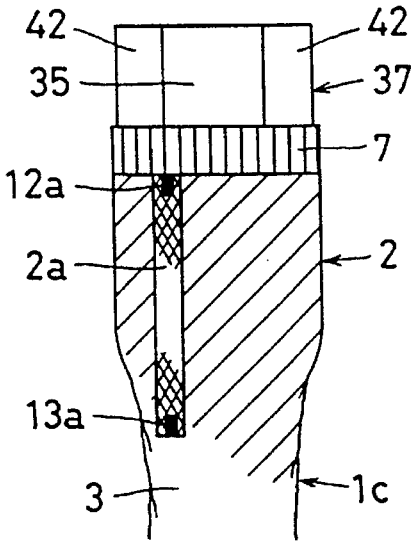
FIG. 9(D) is a plan view of a panty portion of the T-band type blank at a first position with the panty portion inserted in place.
Figure 10:
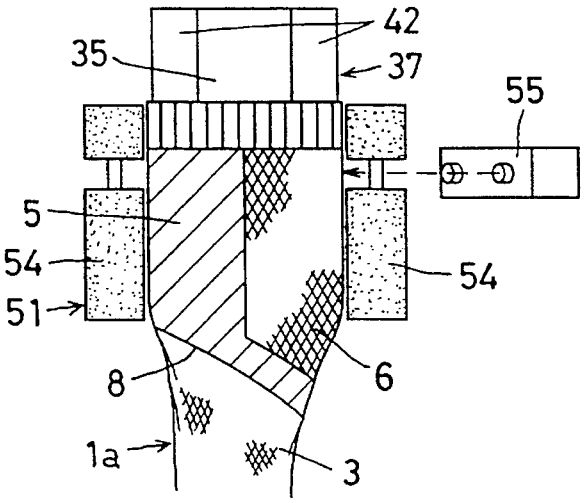
FIG. 10(A) is a plan view of the panty portion of the stereo-knit type blank at a second position at which the boundary of the front and hip portions of the panty portion is positioned.
FIG. 10(B) is a vertical sectional front view of the same.
FIG. 10(C) is a plan view of the bikini type blank at a second position at which the blank is positioned.
FIG. 10(D) is a vertical sectional view of the same.
FIG. 10(E) is a plan view of the T-band type blank at a second position at which the blank is positioned.
FIG. 10(F) is a vertical sectional view of the same.
Figure 10:
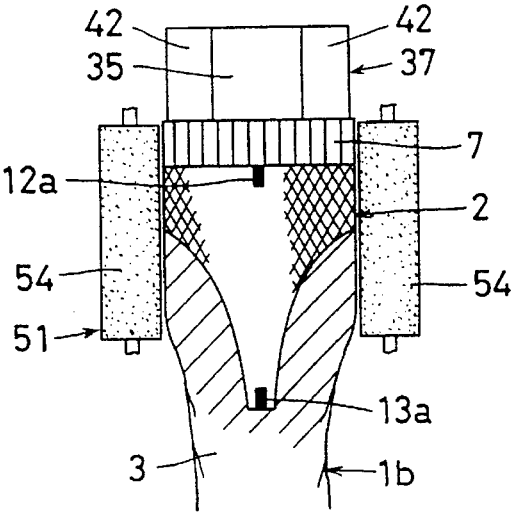
Figure 10:
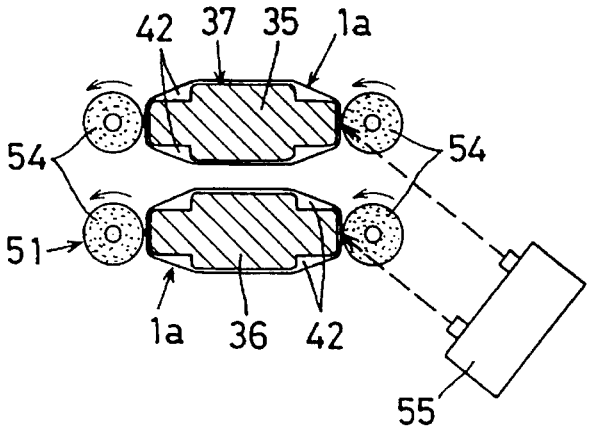
Figure 10:
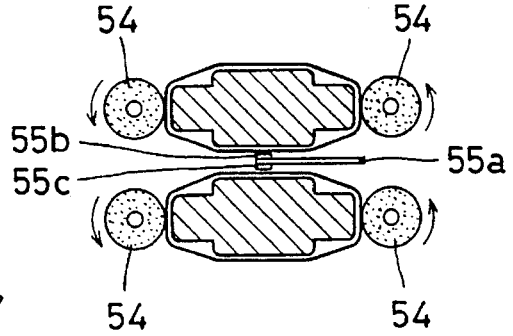
Figure 10:
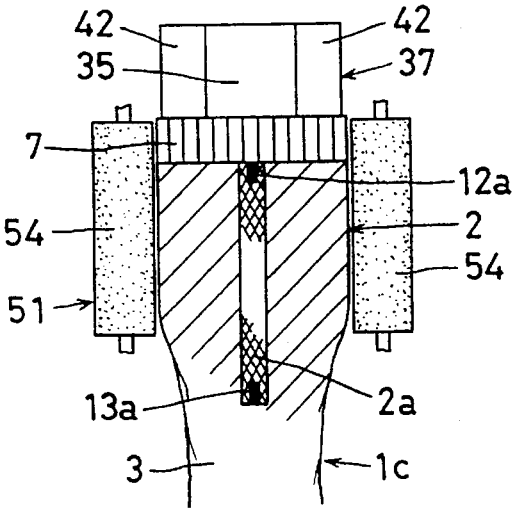
Figure 10:
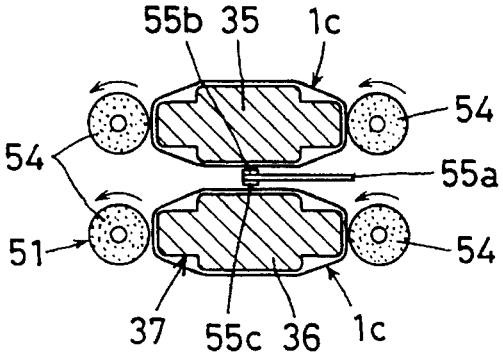

FIG. 9(C) shows a panty portion of bikini type blank 1*b* as inserted on insertion plate 35; 36, and FIG. 9(D) shows a panty portion 2 of T-band type blank 1*c* as inserted on insertion plate 35; 36.

In the case of stereo-knit type blanks 1*a*, 1*a*, when panty portions 6 of blanks 1*a*, 1*a* are inserted on the upper-lower insertion plate pair 37 at the first position, the chains 32, 32 go into 1-pitch rotation. When the upper-lower insertion plate pair 37 stops at the second position, revolving rollers 54, 54 on standby at their lowered position, as shown by solid line in FIG. 7, move upward to their elevated position at which the revolving rollers 54, 54 move toward each other for abutment against the sides of the upper and lower insertion plates 35, 36 through the panty portions 6, so that as FIG. 10(B) shows the panty portions 6 are caused to shift widthwise of the insertion plates 35, 36 through the rotation of the revolving rollers 54, 54.

Simultaneously with this shifting, the sensor unit 55 goes into operation to detect the marking yarn 12 applied to the hip portion 6. When the marking yarn 12 is detected as being positioned at a side of the insertion plate 35 or 36, the revolving rollers 54, 54 are caused to stop running and move away from the insertion plates 35, 36 for return to their lowered position.

When the sensor unit 55 detects the marking yarn 12, as FIG. 10(A) shows, the boundary 9 between the front portion 5 and the hip portion 6 in the panty portion 6 is positioned on a center line extending across the insertion plates 35, 36.

Figure 11A:
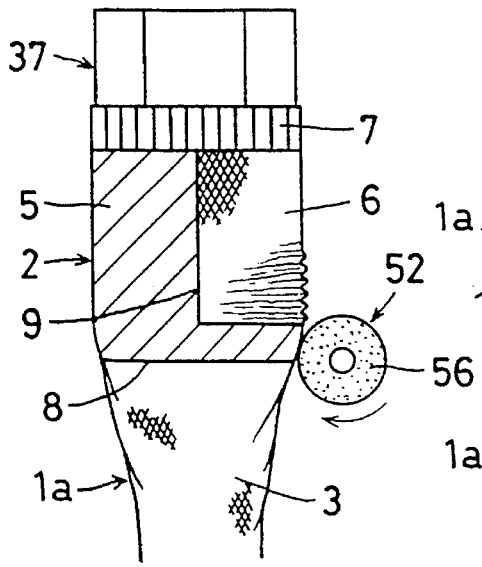
FIG. 11(A) is a plan view showing the panty portion of the stereo-knit type blank at a third position at which a pull is given to the panty portion.
Figure 11B:
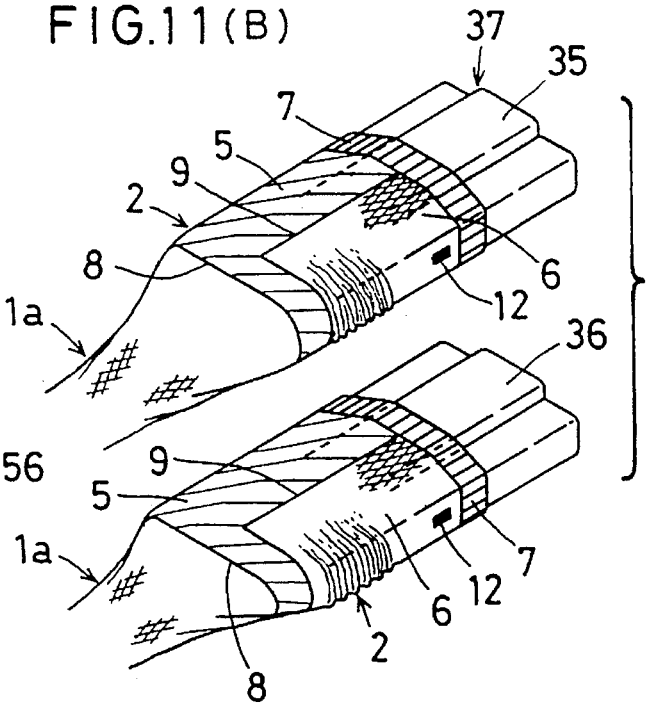
FIG. 11(B) is an exploded perspective view of an upper and lower insertion plate pair as seen at the same position.

Then, the chains 32, 33, 34 go into 1-pitch rotation and, when the upper-lower insertion plate pair 37 stops at the third position, the vertical revolving roller 56 is moved upward for contact with a side of the forward end portions of the insertion plates 35, 36. Thus, as FIG. 11(A) shows, through the rotation of the vertical revolving roller 56, the hip portions 6 are drawn onto the insertion plates 35, 36 to become creased and, as FIGS. 11(A), 11(B) show, the run guard portions 8 of the panty portions are positioned in orthogonal relation to a center line extending across the insertion plates 35, 36 at forward end portions thereof.

When the vertical revolving roller 56 stops rotating and returns to its lowered position, the pull-out and mount mechanism 53 goes into operation so that the pawls 68, 68 on standby at a starting position shown by solid line in FIG. 6 are lowered through the stretching of the cylinder 61 and are then caused to move forward through the shifting of the slider 58. This forward movement is continued toward the upper-lower insertion plate pair 37 which is at a stop at the third position c.

Figure 12A:
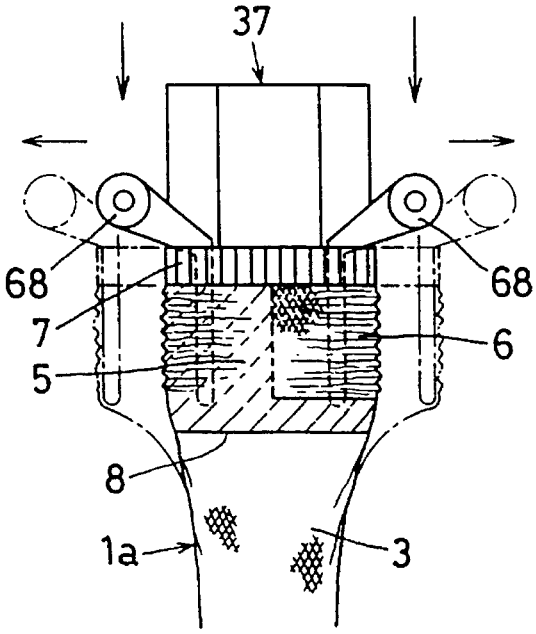
FIG. 12(A) is a plan view of the panty portion of the stereo-knit type blank at the third position as seen when the panty portion is being withdrawn.
Figure 12B:
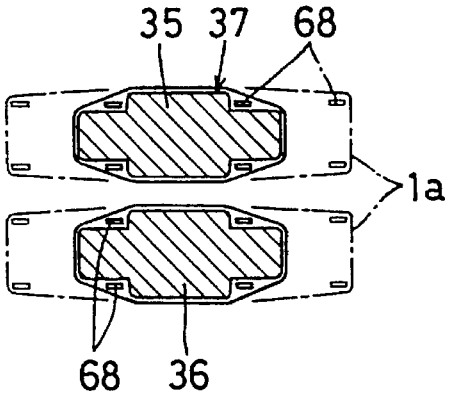
FIG. 12(B) is a vertical sectional front view of the same.

While moving forward in this way, the pawls 68, 68 enter the stepped recess portions 42 formed on the surfaces of the upper and lower insertion plates 35, 36, as shown in FIGS. 12(A) and 12(B). In this case, the insertion plates 35, 36 have panty portions 6 inserted thereon respectively. Therefore, the pawls 68, 68 enter a space between the inner periphery of panty portion 6 and stepped recess portion 42. When the pawls 68, 68 reach the upper and lower insertion plates 35, 36, they stretch laterally on opposite sides through the stretch movement of the cylinder 69. Thus, as FIGS. 12(A), 12(B) show, each panty portion 6 is stretched wide by four pawls 68 in opposite directions, so that the panty portion 6 is passed from the insertion plate 35; 36 to the pawls 68. The pawls 68, 68 move forward further as they remain stretched wide and finally cause the panty portions 6 held in stretched condition to be withdrawn forward of the insertion plates 35, 36.

Figure 8:
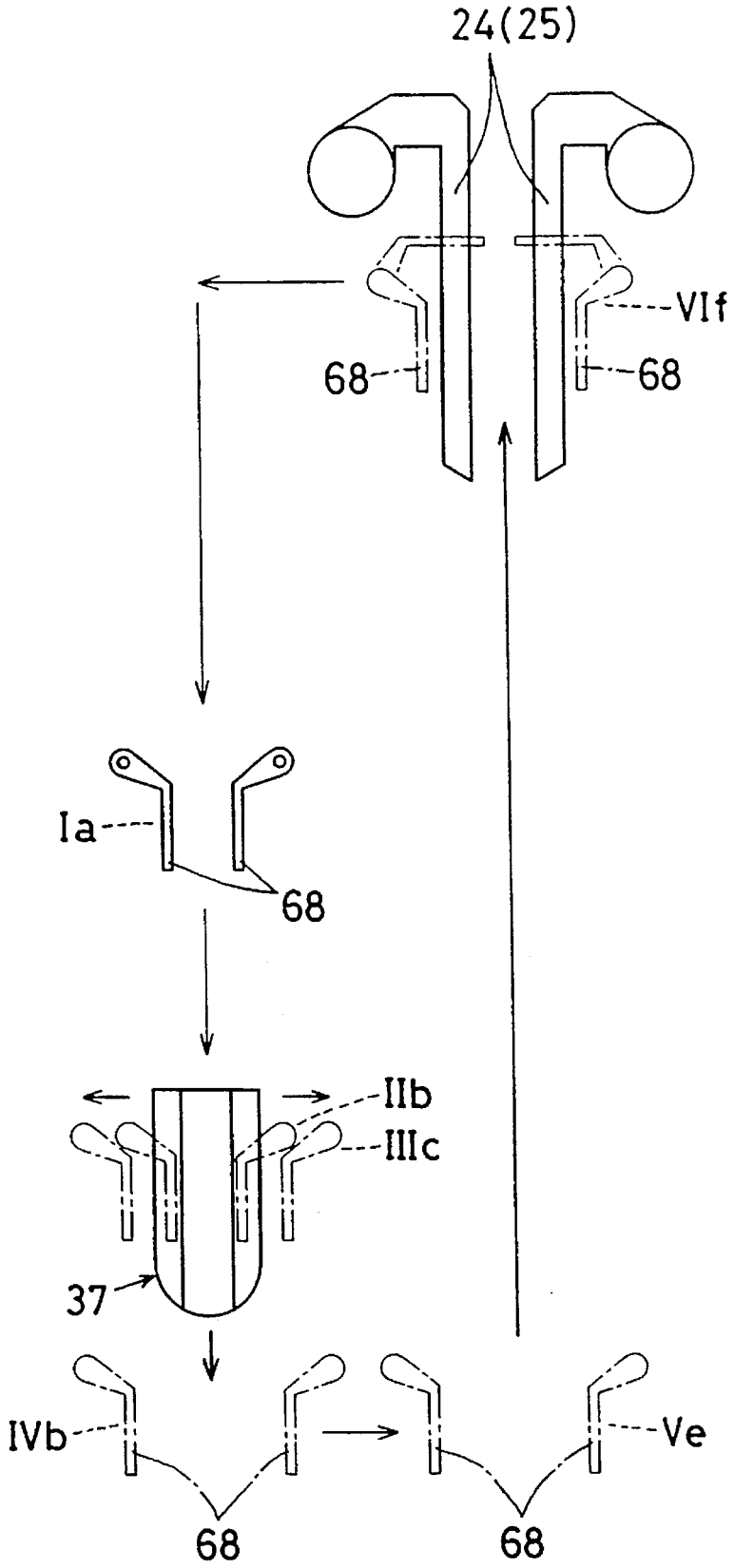
FIG. 8 is a plan view showing the movement of pawls.
Figure 13:
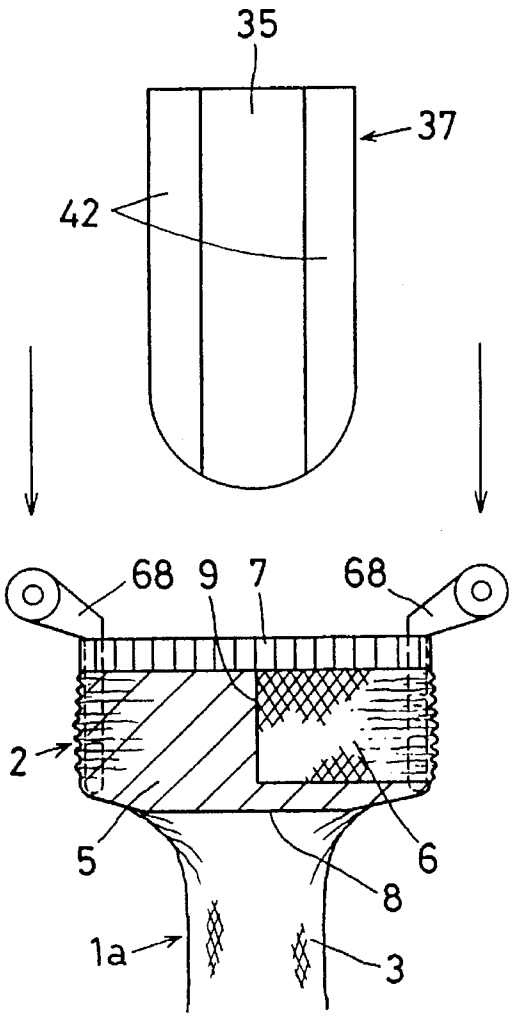
FIG. 13 is a plan view showing the panty portion as withdrawn at said third position.

FIG. 8 shows the process of operation of pawls 68, 68 of the pull-out and mount mechanism 53. The pawls 68, 68 move downward from a standby position Ia for starting, and then move forward until they reach the upper-lower insertion plate pair 37 or position IIb at which they stop. At this position, the pawls 68, 68 enter into a space between the recessed step portions 42 of insertion plate 35, 36 and the inner periphery of panty portion. Thereafter, this position becomes a stretching position IIIc at which each panty portion 6 is stretched wide in laterally opposite directions. Then, the pawls advance to a foremost position IVb (as shown in FIG. 13).

When the pawls 68, 68 reach the foremost position, the traverse member 64 shown in FIG. 5 is actuated by a drive source such as cylinder to move laterally along the first guide rail 63 so that a center between the pawls 68, 68 becomes a position Ve located forward along a center line between upper and lower pairs of holder plates 24, 24 and 25, 25 which stop at the first operating station I.

Figure 14:
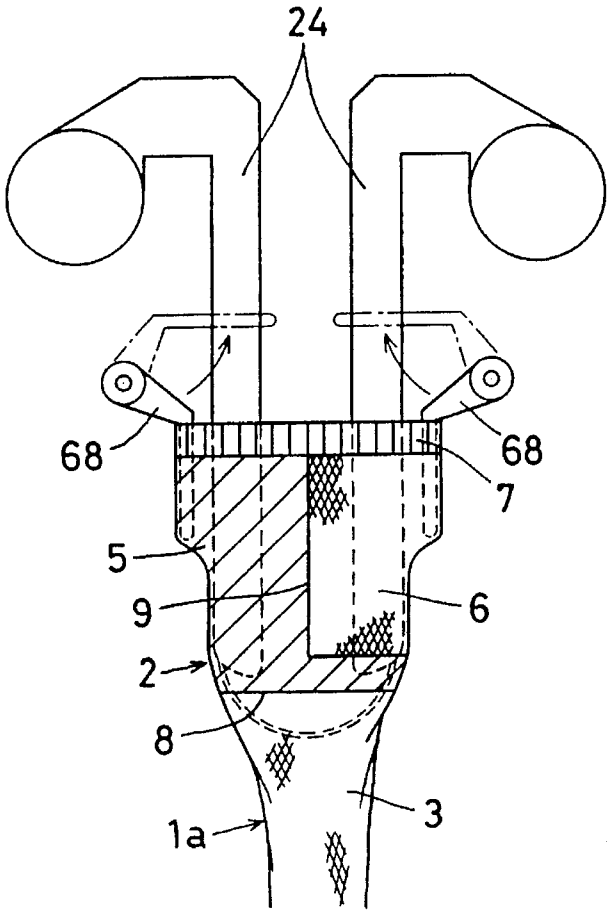
FIG. 14 is a plan view of the panty portion as inserted over a stretch holder member of the crotch sewing machine.

Next, as the slider 58 moves backward along the guide shaft 57, the pawls 68, 68 move toward the upper and lower pairs of holder plates 24, 24 and 25, 25 and, when they reach their respective retreated positions VIf located on both sides of the middle of the upper and lower pairs of holder plates 24, 24 and 25, 25, individual panty portions 2 held in stretched condition as shown in FIG. 14 are inserted over the holder plates 24, 24 of the upper pair and holder plates 25, 25 of the lower pair respectively.

When panty portions 2 are inserted by pawls 68, 68 over holder plates 24, 24 and 25, 25 of the upper and lower pairs, those portions of the panty portions 2 which have not been stretched by pawls 68, 68 come into contact with the forward ends of the holder plates, with the result that creases in the panty portions 2 in creased condition are smoothed. Thus, when the pawls 68, 68 stop at their retreated position VIf, the panty portions 2 are in a crease-free condition as shown in FIG. 14.

When the pawls 68, 68 reach their retreated position, they are actuated by a suitable drive source to pivot 90° inward relative to each other, with the pivot shaft for the mobile members 67 being used as fulcrum. Through this pivotal movement, the pawls 68, 68 can slip out of the panty portion 2.

Figure 15A:
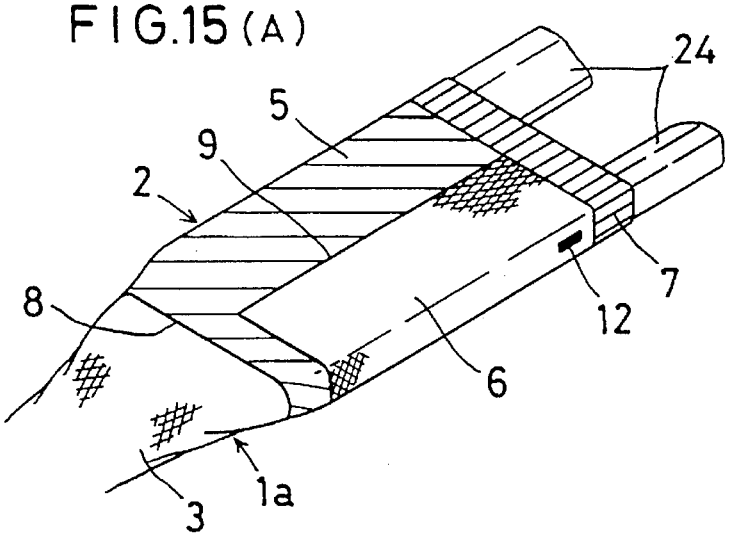
FIGS. 15(A) and 15(B) are exploded perspective views of panty portions of stereo-knit type blanks inserted over a pair of holder plates, upper and lower.
Figure 15B:
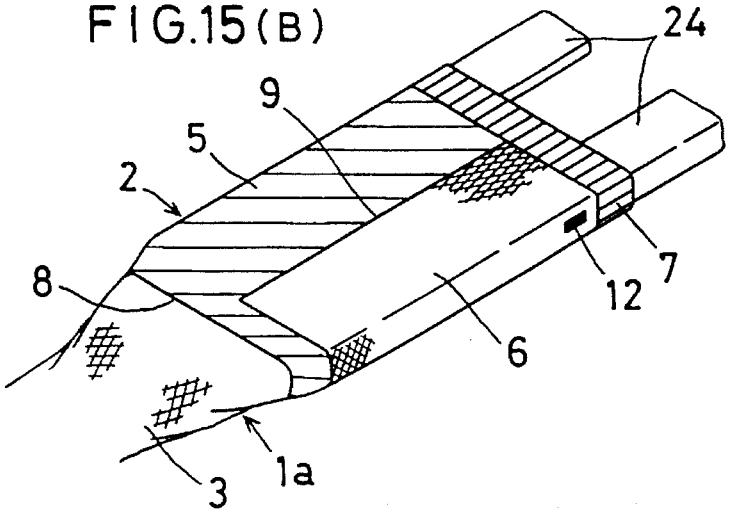

Thus, respective panty portions 2, as FIGS. 15(A) and 15(B) show, are completely mounted on the upper and lower pairs of holder plates 24, 24 and 25, 25 so that each panty portion 2 has a boundary 9 between its front portion 5 and hip portion 6 positioned on a center line between the corresponding pair of holder plates. Further, each run guard portion 8 is positioned at right angles to the longitudinal direction of the corresponding pair of holder plates. In this way, accurate mounting to each stretch holder member 23 can be achieved.

When pawls 68, 68 pivot at their retreated position VIf, they pivot 90° reverse to return to their original position. Then, they move upward and, through lateral movement and forward movement of the traverse member 65, the pawls return to the start standby position 1*a* so as to be ready for a next cycle of pull-out and mount operation.

As stated above, each time an upper-lower insertion plate pair 37 with a pair of pantyhose blanks 1*a*, 1*a* fitted thereon stops at the third position (3), the drawing mechanism 52 and pull-out and mount mechanism 53 perform above described operation; pantyhose blanks 1, 1 are positioned and mounted on stretch holder members 23 on standby at the first operating station I of the crotch sewing machine 21; and during the movement of the stretch holder members 23 of the crotch sewing machine 21 from the first operating station I to the sixth operating station VI, the blanks are sewn into a pantyhose.

When the blanks are withdrawn at the third position (3) in the mounting apparatus 31, the upper-lower insertion plate pair 37 is moved to the first position a at which blanks are to be mounted.

In the case of stereo-knit type blanks, the blanks are mounted in position on a stretch holder member 23 via the process of positioning as described above. Also, in the case of bikini type blanks 1*b*, as well as T-band type blanks 1*c*, the blanks may be mounted in position on a stretch holder member 23 through a substantially similar process.

Figure 15C:
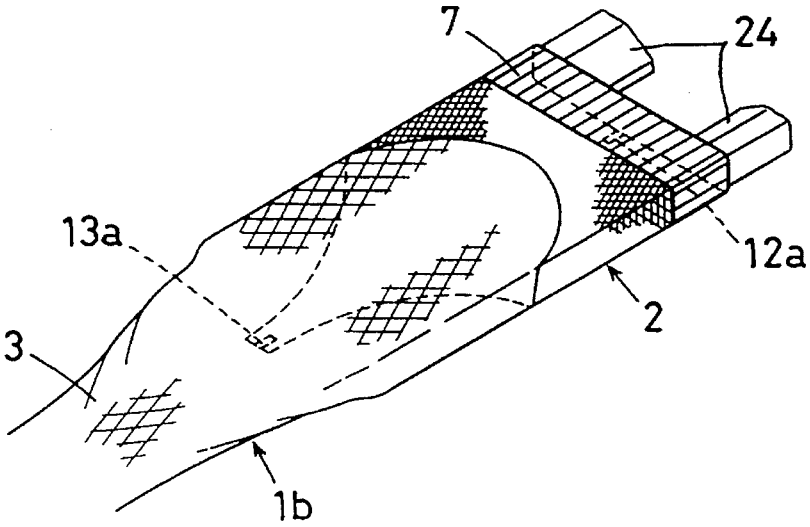
FIGS. 15(C) and 15(D) are exploded perspective views of panty portions of bikini type blanks inserted over upper and lower holder plates.
Figure 15D:
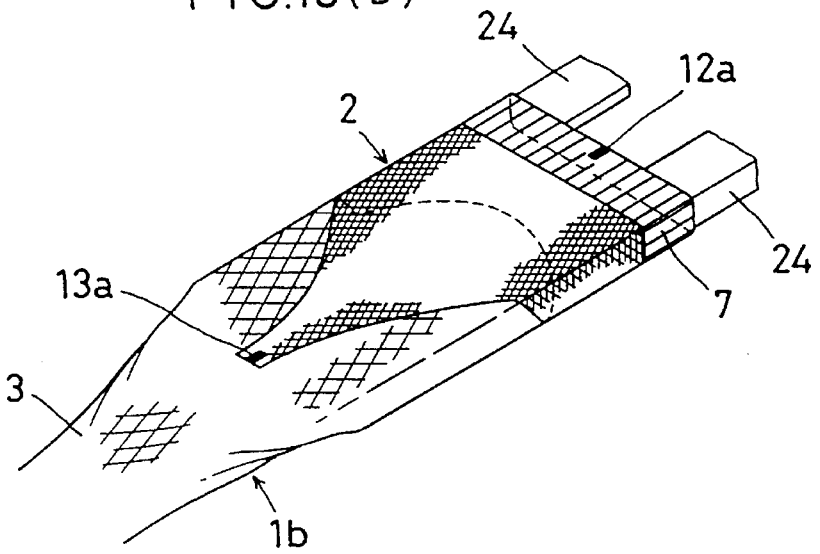

In the case of bikini type blanks 1*b*, 1*b*, at the second position b, revolving rollers 54, 54 come in contact with opposite sides of upper and lower insertion plates 35, 36 with the blanks 1*b*, 1*b* inserted thereon, as shown in FIGS. 10(C) and 10(D), thereby shifting the blanks 1*b*, 1*b* in the widthwise direction. When marking yarns 12*a*, 12*a* are detected by the upper and lower sensors 53*b*, 53*b* advanced into a space between the upper and lower insertion plates 35, 36, the revolving rollers 54, 54 are stopped, whereupon the crotch portions are positioned in vertically opposed relation as shown in FIGS. 15(C) and 15(D).

Figure 15E:
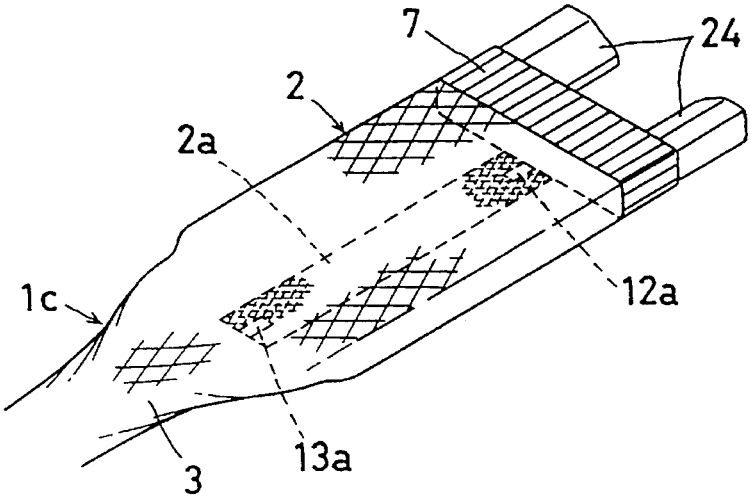
FIGS. 15(E) and 15(F) are exploded perspective views of panty portions of T-band type blanks inserted over upper and lower holder plates.
Figure 15F:
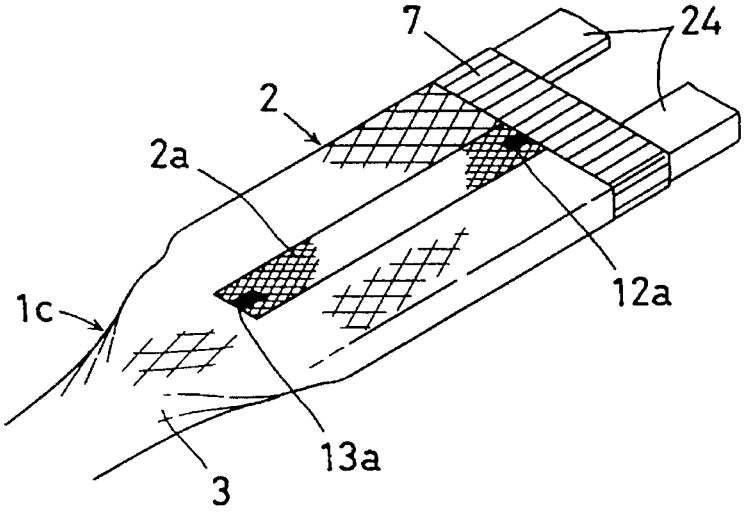

In the case of T-band type blanks 1*c*, 1*c*, as FIGS. 10(E) and 10(F) show, positioning is carried out in the same way as in the case of bikini type blanks 1*b*, so that the belt-like portions 2*a*, 2*a* are positioned in vertically opposed relation as shown in FIGS. 15(E) and 15(F).

Next, a second embodiment will be explained with reference to FIGS. 16 through 23. It is understood that since the crotch sewing machine and mounting apparatus in the second embodiment are basically identical in construction with those in the above described first embodiment, parts identical with those in the first embodiment are designated by like reference numerals and/or characters, no description being repeated with respect to those parts.

Figure 16:
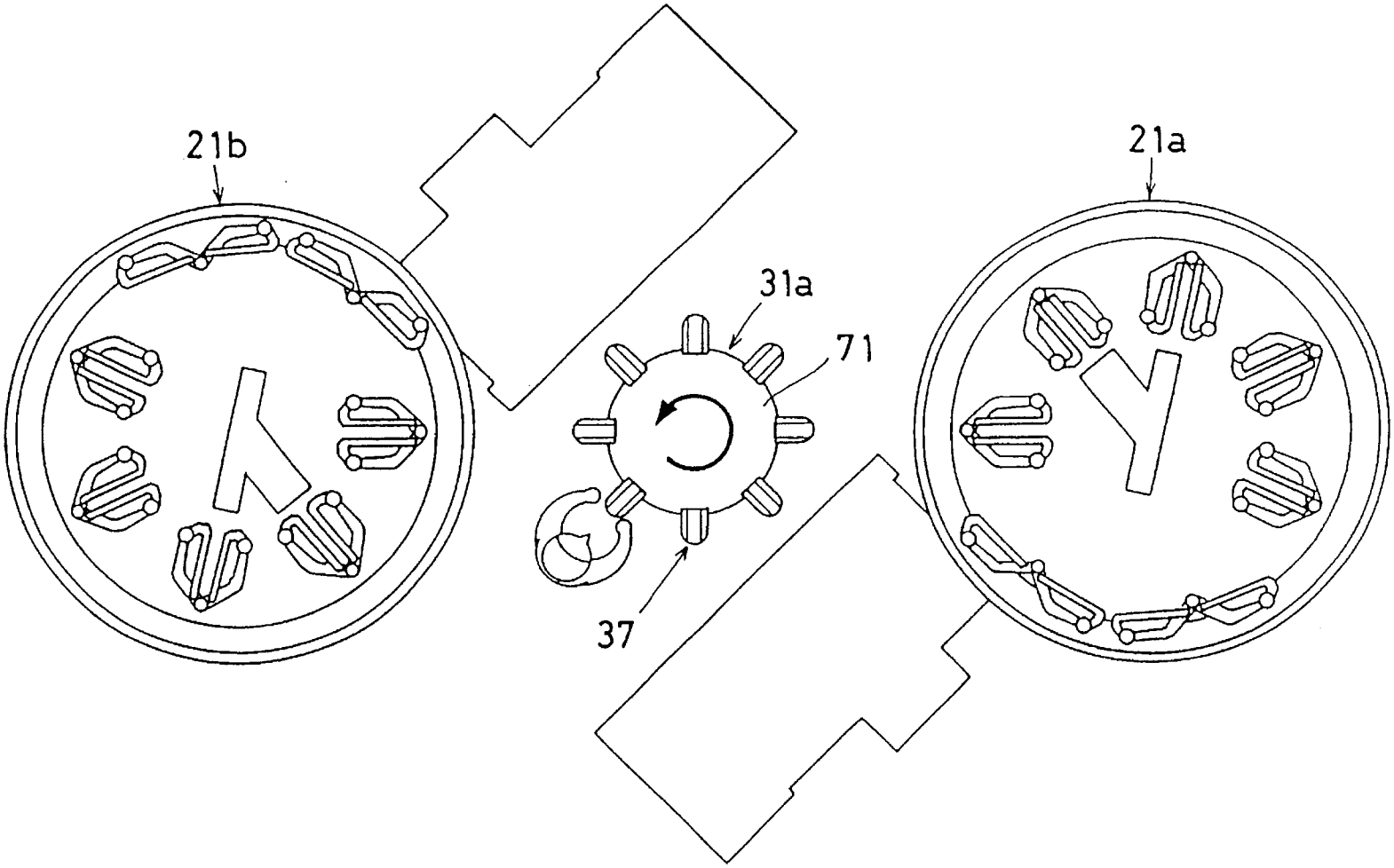
FIG. 16 is a plan view showing a blank mounting apparatus representing a second embodiment.

In this second embodiment, as FIG. 16 shows, the mounting apparatus 31*a* is such that one mounting apparatus 31*a* can mount pantyhose blanks 1*a*, 1*b*, 1*c* onto two crotch sewing machines 21*a*, 21*b*. The apparatus comprises a circular table 71 disposed between a first crotch sewing machine 21*a* and a second crotch sewing machine 21*b*, the circular table 71 having circumferentially equally spaced 8 positions arranged therealong, two sets, upper and lower, of insertion plate pairs 37, 37*a* mounted on the table at each of the eight positions, the circular table 71 being adapted to be driven for intermittent rotation at eight equally spaced intervals in the counterclockwise direction, each set of insertion plate pairs 37, 37*a* being arranged to stop sequentially at predetermined positions of first position (1) through eighth position (8).

The two sets of upper-lower insertion plate pairs 37, 37*a*, as FIGS. 18(A) and 18(B) show, are such that upper and lower insertion plates 35, 36 as used in the first embodiment are arranged in two sets or pairs in vertically spaced relation. Individual insertion plates 35, 36 and 35, 36 are joined at their rear ends by a connecting member 72. A shaft 73 projects from the rear side of the connecting member 72 at a vertically median site thereof, the shaft 73 being rotatably supported by a bracket not shown which is provided upright on the table 71. Each two-set assembly of insertion plate pairs is mounted on the table 71 so as to be vertically inverted 180° by a suitable drive mechanism.

It is noted that illustrations given in FIGS. 18(A), 18(B), 19, 20(A), 20(B), 21(A), 21(B), and 22(A) exemplify cases in which stereo-knit type blanks 1*a*, 1*a* are used.

Figure 17:
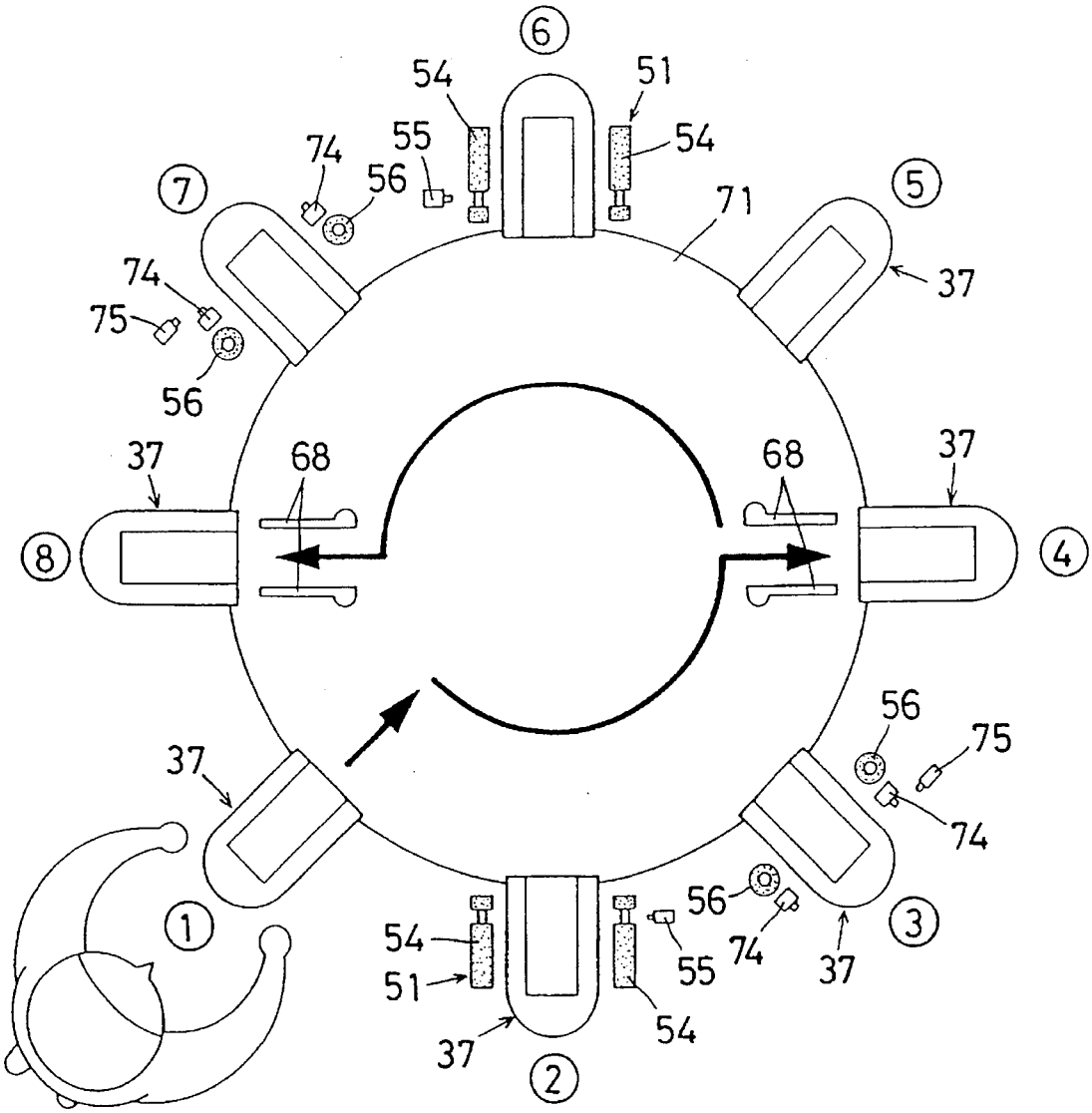
FIG. 17 is an enlarged plan view showing principal portions of the apparatus.
Figure 18:
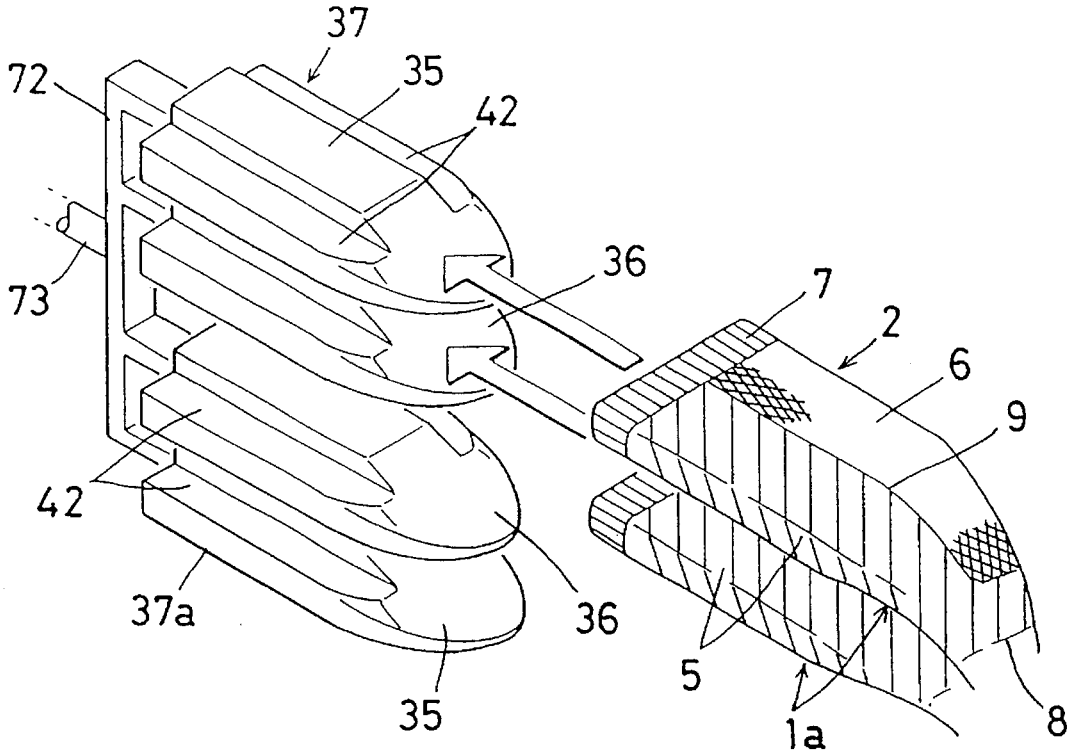
FIG. 18(A) is a perspective view showing upper and lower pairs of insertion plates and stereo-knit type blanks at a first position in the apparatus.
FIG. 18(B) is a perspective view showing the blanks as vertically inverted.
Figure 18:
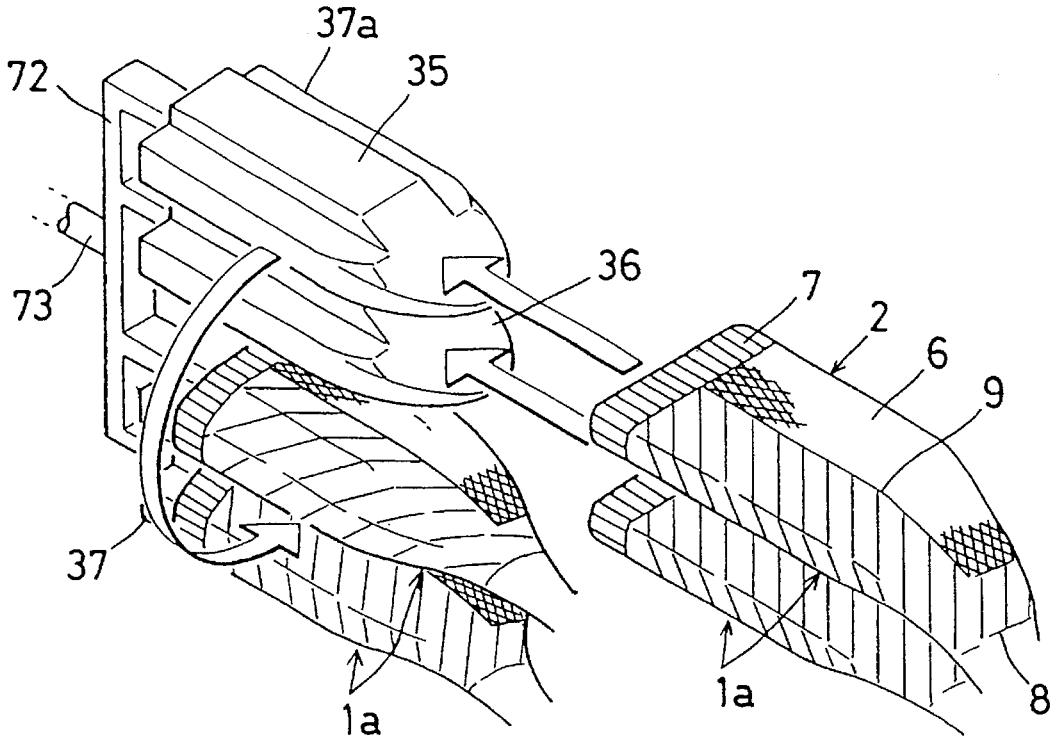

As may be seen from FIG. 17, the first position (1) is a position at which the operator inserts pantyhose blanks 1*a* onto two sets of upper-lower insertion plate pairs 37, 37*a;* the second position (2) and the sixth position (6) are positions at which a boundary 9 between front portion 5 and hip portion 6 of inserted panty portion 2 is positioned in alignment with a center line extending across the corresponding insertion plate; the third position (3) and the seventh position (7) are positions at which panty portion 2 and hip portion 6 are drawn onto the insertion plate in creased condition so that run guard portion 8 of the panty portion 2 is positioned at a predetermined site on the insertion plate; and the fourth position (4) and the eighth position (8) are positions at which pantyhose blanks 1 are withdrawn from insertion plate pair and panty portions 2 of the withdrawn blanks are mounted to crotch sewing machine 21*a*, 21*a*.

Therefore, the mounting apparatus 71 is arranged in such a way that the fourth position (4) faces a stretch holder member 23 which stops at the first operating station I of the first crotch sewing machine 21*a* and the eighth position (8) faces a stretch holder member 23 which stops at the first operating station I of second crotch sewing machine 21*b*.

Figure 20:
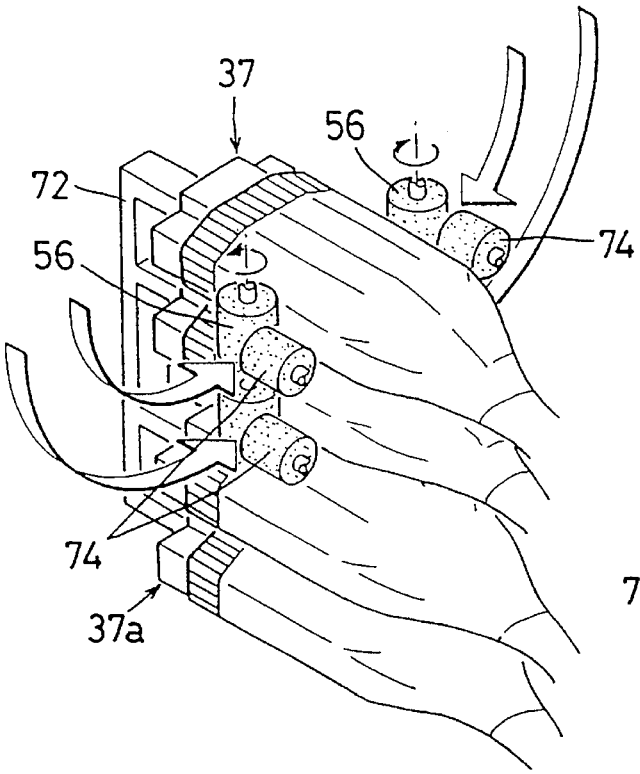
FIG. 20(A) is a perspective view showing the same at a third position.
FIG. 20(B) is a plan view thereof.
FIG. 20(C) is a similar plan view in the case of bikini type blanks.
FIG. 20(D) is a similar plan view in the case of T-band type blanks.
Figure 20:
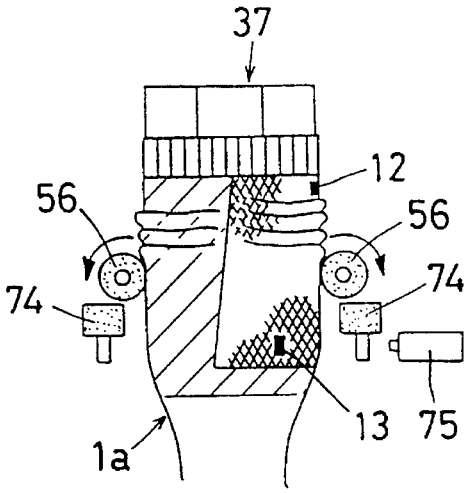
Figure 20:
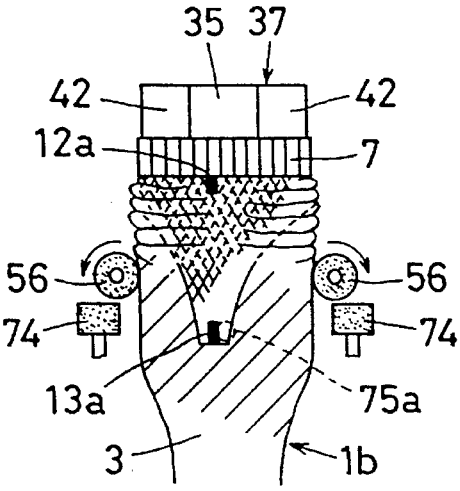
Figure 20:
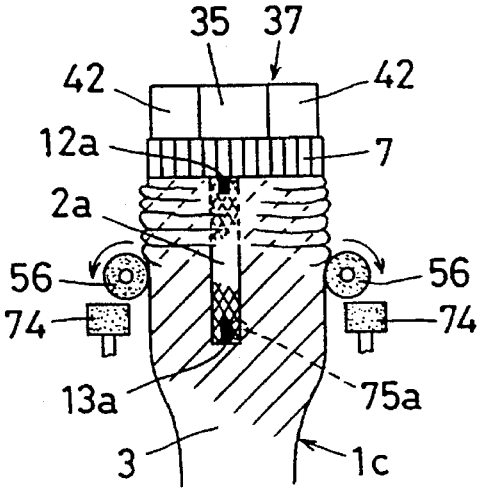

In aforesaid third position (3) and seventh position (7), as FIGS. 20 and 21 illustrate, in association with vertical rollers 6 operative to draw panty portion 2, revolving rollers 74 movable toward and away from sides of insertion plate are vertically movably arranged at opposite sides of a front end portion of upper-lower insertion plate pair 37 for shifting the panty portion 2 positioned adjacent the front end portion of the insertion plate, at a site close to the lower portion of the panty portion 2 so as to enable sensor unit 75 to detect lower marking yarn 13, so that the boundary 9 between the front portion 5 and the hip portion 6 of the panty portion 2 can, in its entire length, be positioned in alignment with a center line extending across the insertion plate. It is noted in this connection that during the shifting of the panty portion 2 through roll engagement by the revolving rollers 74 the vertical revolving rollers 56 will hold the panty portion 2 in pressed condition so that no off-position trouble will occur with respect to the upper portion positioned prior to the panty portion 2.

Next, the method of mounting with respect to the second embodiment will be explained.

When two sets, upper and lower, of upper-lower insertion plate pairs 37, 37*a* are at the first position (1) as shown in FIG. 18(A), the operator inserts panty portions 2 of a pair of blanks 1*a*, 1*a* onto insertion plates 35, 36 of the upper side pair 37. Then, as FIG. 18(B) shows, the insertion plate pairs 37, 37*a* are vertically inverted 180° and panty portions 2 of a pair of blanks 1*a* are inserted on the insertion plate pair 37*a* which is now on the upper side.

Figure 19A:
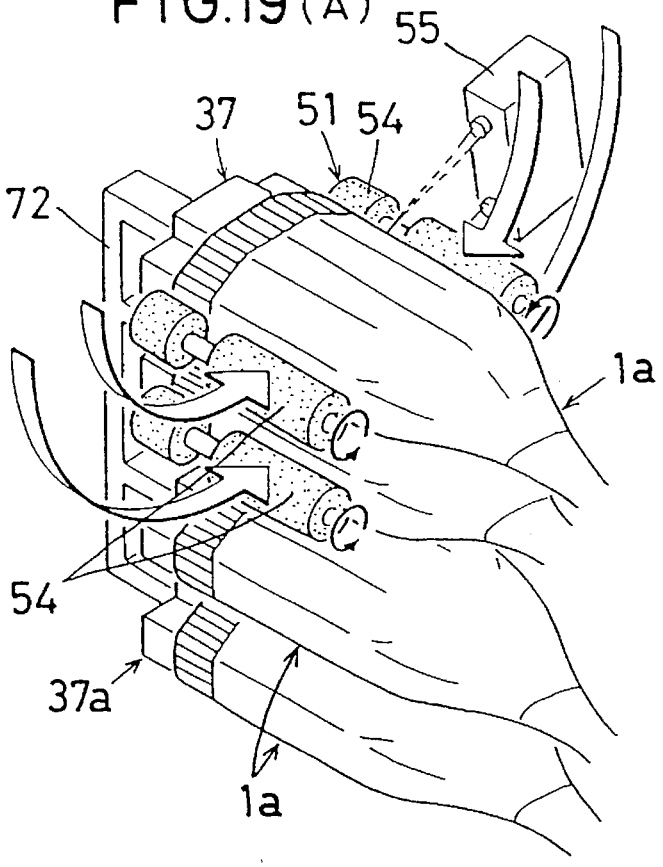
FIG. 19(A) is a perspective view showing the same at a second position.
Figure 19B:
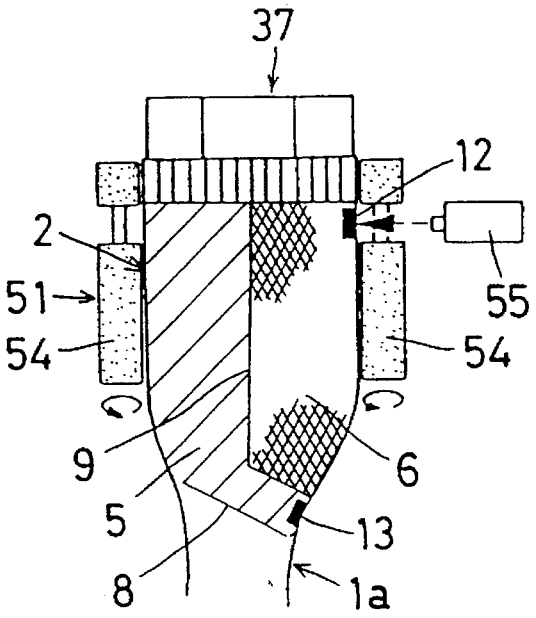
FIG. 19(B) is a plan view thereof.

Upon insertion of panty portions 2 on the upper and lower sets of insertion plate pairs 37, 37*a*, the circular table 71 is intermittently rotated. At the second position (2), as FIGS. 19(A) and 19(B) show, panty portions 2 inserted on the upper insertion plate pair 37 are rotated by revolving rollers 54 and the sensor unit 55 detects an upper marking yarn 12, whereby the boundary 9 between the front portion 5 and the hip portion 6 of each panty portion 2 is positioned in alignment with a center line extending across insertion plate 35, 36.

Next, at the third position (3), as FIGS. 20(A) and 20(B) show, vertical revolving rollers 56 engage the upper side insertion plate pair 37 at both sides to draw the panty portions 2 onto the insertion plates 35, 36 in a creased condition. Subsequently, the revolving rollers 74 engage the upper insertion plate pair 37 at both sides to shift lower portions of the panty portions 2 in the widthwise direction thereby to enable a lower marking yarn 13 to be detected by the sensor unit 75. Through this process positioning is effected with respect to a lower boundary 9 for panty portion 2, and a run guard portion 8 is positioned at right angles to a center line extending across insertion plate 35, 36.

Figure 22:
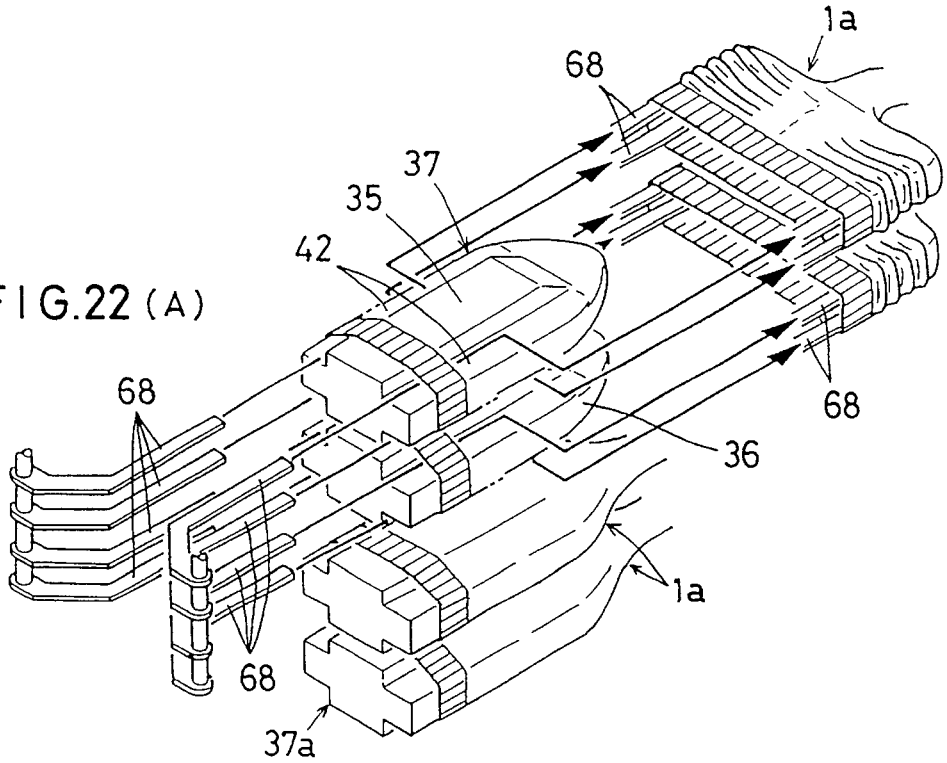
FIG. 22(A) is a perspective view showing stereo-knit type blanks at a fourth position.
FIG. 22(B) is a plan view showing bikini type blanks at a fourth position.
FIG. 22(C) is a similar plan view of T-band type blanks at a fourth position.
Figure 22:
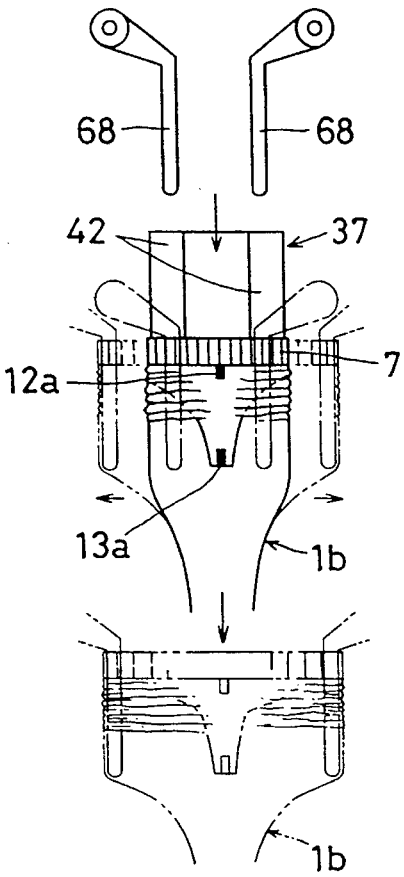
Figure 22:
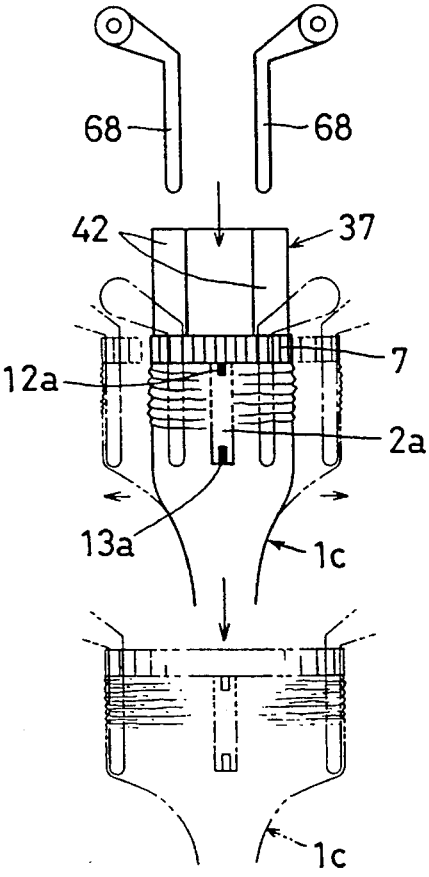
Figure 23:
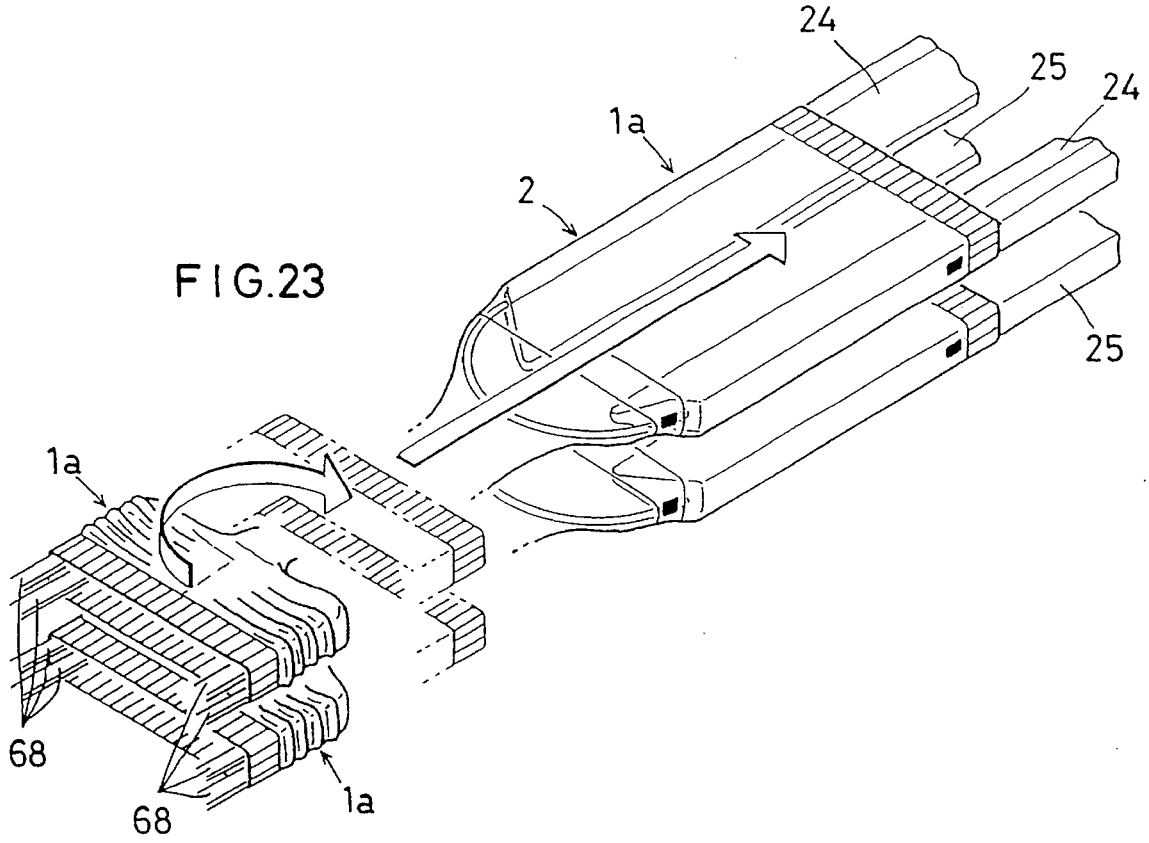
FIG. 23 is a perspective view showing the step of fitting panty portions on stretch holder members at the fourth position.

At the fourth position (4), as FIG. 22 shows, pawls 68, 68 advance toward the upper insertion plate pair 37. Upon reaching the upper insertion plate pair 37, the pawls 68, 68 stretch in opposite lateral directions to hold the panty portions 2 in stretched condition. Then, the pawls advance further to withdraw the panty portions 2 from the upper insertion plate pair 37. Then, as FIG. 23 shows, the pawls 68, 68 are caused by suitable drive mechanism and rotation support mechanism to turn 180° horizontally. In this condition, the pawls 68, 68 advance further and insert panty portions 2 in position over stretch holder member 23 in the first crotch sewing machine 21*a*. Thereafter, the pawls 68, 68 move forward to exit the panty portions 2 and return to their retreated position.

Figure 24:
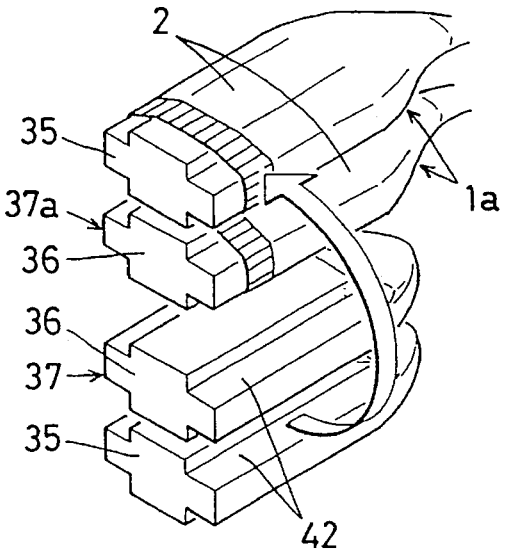
FIG. 24 is a perspective view showing panty portions at a fifth position.

At the fifth position (5), as FIG. 24 shows, two sets, upper and lower, of insertion plate pairs 37, 37*a* are vertically inverted 180 so that the insertion plate pair 37 from which blanks have been removed is positioned lower, while the insertion plate pair 37*a* which is fitted with blanks 1*a* is positioned upside.

At the sixth position (6), the boundary 9 for panty portion 2 on the upper side insertion plate pair 37*a* is positioned in alignment with a center line extending across each insertion plate, in the same way as at the second position (2). At the seventh position (7), panty portion 2 is drawn and a lower boundary 9 is positioned in the same way as at the third position (3). At the eighth position (8), panty portion 2 is withdrawn by pawls 68, 68 from upper insertion plate pair 37*a* and the same is inserted on a stretch holder member 23 stopping at the first operating station I of the second crotch sewing machine 21*b*, in the same way as at the fourth position (4).

Figure 21A:
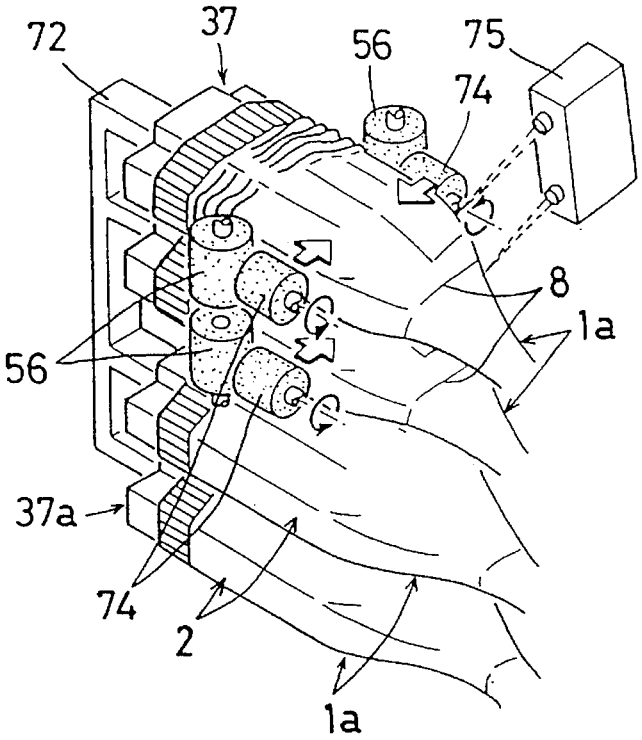
FIG. 21(A) is a perspective view showing the step of positioning stereo-knit type blanks at the third position.
Figure 21B:
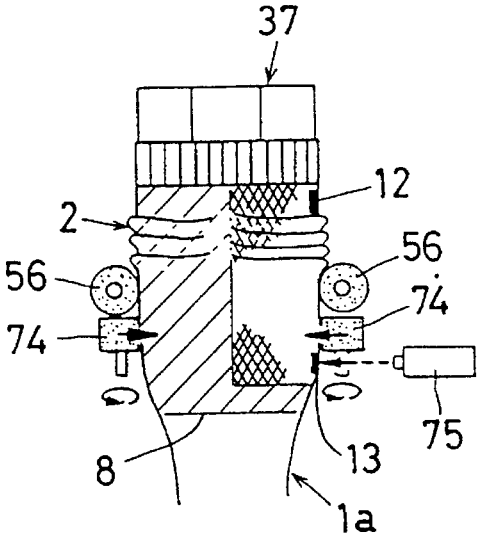
FIG. 21(B) is a plan view thereof.
Figure 21C:
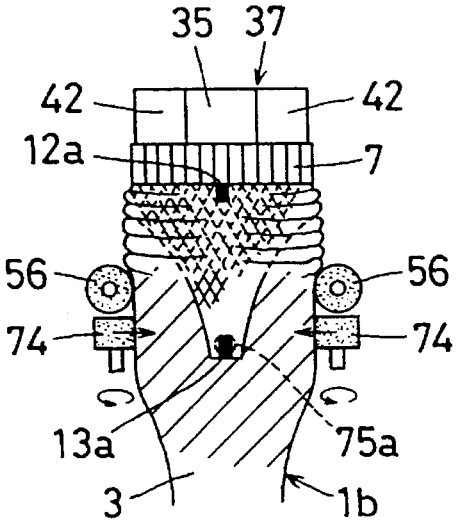
FIG. 21(C) is a similar plan view showing the step of positioning in the case of bikini type blanks.

FIG. 20(C) shows a panty portion 2 being drawn at the third position (3) in the case of bikini type blanks 1*b*, 1*b*. In this case, panty portion 2 is drawn by vertical revolving rollers 56 in a creased condition onto insertion plate 35, 36. Then, as FIG. 21(C) shows, revolving rollers 74 engage the upper insertion plate pair 37 at both sides thereof to shift the lower portion of panty portion 2 in the widthwise direction. When a lower marking yarn 13*a* is detected by a detector 75*a* having upper and lower sensors, the revolving rollers are caused to stop rotation whereby a cutting position for the crotch portion is set in alignment with a center line extending across insertion plate 35, 36.

Thereafter, as FIG. 22(B) shows, pawls 68, 68 are caused to remove blanks 1*b*, 1*b* from the upper insertion plate pair 37*a*, the blanks being then inserted on a stretch holder member.

Figure 21D:
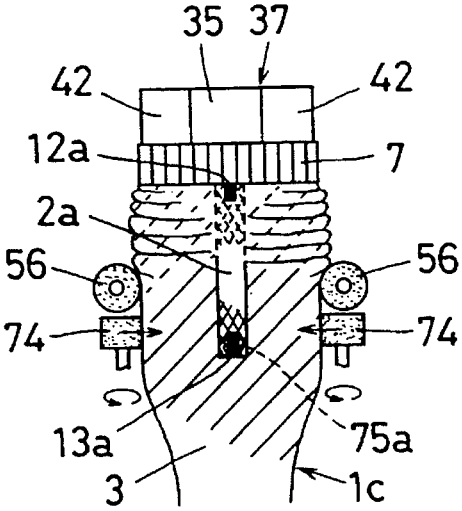
FIG. 21(D) is a similar plan view showing the step of positioning in the case of T-band type blanks.

FIGS. 20(D), 21(D), and 22(C) respectively show T-band type blanks 1*c*, 1*c* being positioned and the same being inserted on a stretch holder member, which process is substantially same as that in the above mentioned case of bikini type blanks 1*b*, 1*b*.

In this way, according to the second embodiment, simply by inserting pantyhose blanks 1*a*, 1*b*, 1*c* on two sets, upper and lower, of insertion plate pairs 37, 37*a* it is possible to position the blanks 1*a*, 1*b*, 1*c* for supply to two crotch sewing machines 21*a*, 21*b*. This provides improved operating efficiency.

As described above, according to the present invention, positioning of a cutting site with respect to panty portions of pantyhose blanks can be automatically performed for accurate supply to a stretch holder member of crotch sewing machine, it being only required that panty portions of a pair of pantyhose blanks be tentatively inserted on an upper-lower insertion plate pair. This provides for considerable simplification of the process of blank mounting onto stretch holder members, and good improvement and labor saving in crotch sewing operation.

Further, desired cutting lines for panty portions can be accurately registered and subsequent sewing by a crotch sewing machine can be accurately carried out. Thus, pantyhose of very high quality can be obtained.

What is claimed is:

1. A method of making pantyhose from a pair of hosiery pantyhose blanks each having a welt or panty-forming portion at one end and slit edges, a foot portion at the other end and a leg portion between the welt and foot portions, the welt portions being adapted to be slit longitudinally of the pantyhose blanks along predetermined portions of the welt portions and the slit edges of the pair of blanks being adapted to be sewn together to form the panty-forming or panty portion of the pantyhose, the welt portions having detectable characteristics indicative of requisite orientation of the hosiery blanks for slitting along said predetermined portions, said method comprising positioning portions of the welt portions of a pair of pantyhose blanks on a pair of positioning forms having free end portions with the portions of the welt portions surrounding the free end portions, rotating the welt portions of the pair of pantyhose blanks on the positioning forms while scanning the welt portions of the pantyhose blanks for the detectible characteristics, detecting the detectible characteristics of the welt portions for each of the pair of pantyhose blanks and stopping the rotation of each welt portion responsive thereto, feeding the properly oriented welt portions of the pantyhose blanks further onto the free end portions of the positioning forms until all of the welt or panty-forming portions of the pantyhose blanks are on the positioning forms, stripping the welt portions of the pair of pantyhose blanks from the positioning forms, and transferring the pair of pantyhose blanks to a pantyhose slitting and sewing machine.

2. A method according to claim 1 wherein the detectable characteristics of the pantyhose blanks are contrasting areas knit into predetermined locations of the pantyhose blanks.

3. A method according to claim 2 wherein the contrasting areas are knit into the welt portions of the pantyhose blanks and each pantyhose blank has an upper contrasting area adjacent the upper end of the welt portion and a lower contrasting area adjacent the lower end thereof.

4. A method according to claim 1 wherein the positioning forms are elongate and have longitudinal centerlines and the welt portions are rotated about the longitudinal centerlines of the positioning forms.

5. A method according to claim 4 wherein the step of feeding the welt portions further onto the positioning forms includes causing the welt portions to gather or bunch in creased condition on the positioning forms.

6. A method according to claim 5 wherein the step of transferring the pantyhose blanks to a pantyhose slitting and sewing machine comprises placing the welt portions on a stretch holding member of the pantyhose slitting and sewing machine while smoothing the gathers or bunches therefrom such that the welt portions are placed on the stretch holding member in smooth, uncreased condition.

7. A method according to claim 3 wherein the step of rotating the welt portions on the positioning forms includes engaging the welt portions adjacent the upper ends thereof with first rotating means while scanning for the upper contrasting areas and, after feeding of the welt portions further onto the positioning forms, engaging the welt portions adjacent the other ends thereof with second rotating means while scanning for the lower contrasting areas.

8. A method according to claim 1 wherein a plurality of pairs of positioning forms are provided in spaced relation on an indexing means and including indexing successively each pair of positioning forms between positioning, rotating, feeding and transfer stations.

9. A method of forming pantyhose from pairs of pantyhose blanks each having a welt or panty-forming portion at one end, a foot portion at the other end and a leg portion between the welt and foot portions, the welt portions having knit characteristics dictating that the welt portions be slit along a predetermined longitudinal portion thereof and having detectable areas indicative of proper orientation for slitting, said method comprising providing a plurality of pairs of juxtaposed, elongate positioning forms arranged in spaced apart relation and indexable along a predetermined path of travel between a plurality of work stations, indexing successive pairs of positioning forms to a pantyhose blank positioning station, positioning portions of the welt portions of a pair of pantyhose blanks on each successive pair of positioning forms at the positioning station, indexing the pair of positioning forms having a pair of pantyhose blanks thereon to an orientation station, rotating the welt portions of the pair of pantyhose blanks about the positioning forms while scanning the same for the detectable areas, detecting the detectable areas of the pantyhose blanks when the pantyhose blanks are in the proper orientation for slitting and stopping the rotation of the welt portions responsive to such detection, indexing the pair of positioning forms having the properly oriented pair of pantyhose blanks thereon to a feeding station, feeding the welt portions of the pantyhose blanks further onto the positioning forms until all of the welt portions are located on the forms while causing the welt portions to gather or bunch thereon in a creased condition, indexing the pair of positioning forms to a transfer station, stripping the welt portions of the pantyhose blanks from the positioning forms by transfer members, and transferring the welt portions of the pantyhose blanks onto a stretch holding member of a slitting and sewing means while removing the gathers therefrom so that the welt portions are in smooth, uncreased condition.

10. A method according to claim 9 wherein the step of providing pairs of positioning forms comprises providing a plurality of spaced apart, indexable carriers each having first and second pairs of positioning forms in spaced relation thereon and wherein the steps of indexing the pairs of positioning forms between the various work stations comprises indexing the plurality of carriers between those work stations.

11. A method according to claim 10 wherein the step of positioning the welt portions of pantyhose blanks on the pairs of positioning forms comprises positioning the welt portions of a pair of pantyhose blanks on the first pair of positioning forms on each carrier and then positioning the welt portions of another pair of pantyhose blanks on the second pair of positioning forms on each carrier.

12. A method according to claim 11 wherein the steps of rotating the welt portions to orient the welt portions for slitting, feeding the welt portions further onto the positioning forms, stripping the pantyhose blanks from the positioning forms and transferring the pantyhose blanks onto a stretch holding member of a slitting and sewing means are performed in succession on the pantyhose blanks on one of the first and second pairs of positioning forms on each carrier and are then performed in succession on the pantyhose blanks on the other of the pairs of positioning forms on each carrier.

13. A method according to claim 12 wherein each of the carriers is indexable to position the two pairs of positioning forms in active and inactive positions thereon and including indexing the first pair of forms from the active to the inactive position after the welt portions of a pair of pantyhose blanks are positioned thereon while indexing the second pair of positioning forms from the inactive to the active position for positioning of pantyhose blanks thereon.

14. A method according to claim 13 wherein the second pair of positioning forms are maintained in the active position while the carrier is indexed through the orienting, feeding and transfer stations and the first pair of positioning forms is then indexed from the inactive position to the active position and maintained in that position while the carrier is indexed through second orienting, feeding and transfer stations.

15. A method according to claim 13 wherein each of the carriers is rotatable and the pairs of positioning forms are supported on opposite sides of the axis thereof.

* * * * *

UNITED STATES PATENT AND TRADEMARK OFFICE

CERTIFICATE OF CORRECTION

PATENT NO. : 5,564,609

DATED : October 15, 1996

INVENTOR(S) : Masataka Tsuchiya et al.

It is certified that error appears in the above-identified patent and that said Letters Patent is hereby corrected as shown below:

On the cover page, Column 1, Inventors, "Masataka Tsuchiya, Nara-ken; Kazuhisa Sugita; Tamotsu Matsuda, both of Yamatotakada, all of Japan" should be -- Masataka Tsuchiya; Kazuhisa Sugita; Tamotsu Matsuda, all of Nara-ken, Japan --;

Column 1, line 6, "1. Field of the Invention" should be -- Field of the Invention --;

Column 5, lines 1 and 5, "35;36" should be -- 35, 36 --;

Column 6, lines 7 and 9, "35.36" should be -- 35, 36 --;

Column 6, lines 53 and 56, "plate" should be -- plates --;

Column 7, line 65, "6" should be -- 2 --;

Column 8, lines 4, 6 and 63, "35;36" should be -- 35, 36 --;

Column 8, lines 8, 16, 29 and 61, "6" should be -- 2 --;

Column 8, line 63, "plate" should be -- plates --;

UNITED STATES PATENT AND TRADEMARK OFFICE

CERTIFICATE OF CORRECTION

PATENT NO. : 5,564,609

DATED : October 15, 1996

INVENTOR(S) : Masataka Tsuchiya et al.

It is certified that error appears in the above-identified patent and that said Letters Patent is hereby corrected as shown below:

Column 9, line 7, "plate" should be -- plates --;

Column 11, line 61, "plate" should be -- plates --;

Column 11, line 25, "6" should be -- 56 --;

Column 12, lines 7, 43 and 51, "plate" should be -- plates --;

Column 12, line 24, "180" should be -- 180° --; and

Column 13, after line 14 and before "What is claimed is:" please insert the following paragraph: -- In the drawings and specifications, there has been set forth a preferred embodiment of the invention, and although specific terms are employed, they are used in a generic and descriptive sense only and not for purposes of limitation, the scope of the invention being set forth in the following claims. --.

Signed and Sealed this

Twenty-eighth Day of January, 1997

*Attest:*

Bruce Lehman

BRUCE LEHMAN

*Attesting Officer* *Commissioner of Patents and Trademarks*